US005631725A

United States Patent [19]

Harasawa et al.

[11] Patent Number: 5,631,725

[45] Date of Patent: May 20, 1997

[54] IMAGE TRANSFER DEVICE FOR AN IMAGE FORMING APPARATUS

[75] Inventors: Yuko Harasawa, Hayama-machi; Itaru Matsuda, Yokohama; Satoshi Takano, Tokyo; Akio Kutsuwada, Kawasaki; Hirokazu Ishii, Tokyo, all of Japan

[73] Assignee: Ricoh Company, Ltd., Tokyo, Japan

[21] Appl. No.: 313,897

[22] Filed: Sep. 28, 1994

[30] Foreign Application Priority Data

Sep. 28, 1993 [JP] Japan ..... 5-241080
Sep. 2, 1994 [JP] Japan ..... 6-210139

[51] Int. Cl.[6] ..... G03G 21/00

[52] U.S. Cl. ..... 399/66; 399/312

[58] Field of Search ..... 355/277, 274, 355/208, 271

[56] References Cited

U.S. PATENT DOCUMENTS

| | | | |
|---|---|---|---|
| 5,083,167 | 1/1992 | Fukushima et al. | 355/274 |
| 5,300,984 | 4/1994 | Fuma et al. | 355/208 |
| 5,386,274 | 1/1995 | Sanpe et al. | 355/215 |
| 5,461,461 | 10/1995 | Harasawa et al. | 355/208 |

FOREIGN PATENT DOCUMENTS

| | | |
|---|---|---|
| 0332223 | 9/1989 | European Pat. Off. . |
| 3-158877 | 7/1991 | Japan . |
| 3-231274 | 10/1991 | Japan . |
| 5-11645 | 1/1993 | Japan . |

OTHER PUBLICATIONS

Patent Abstracts of Japan, vol. 15, No. 399 (P-1261) (4927), Oct. 9, 1991, JP-3-158877, Jul. 8, 1991.

Patent Abstracts of Japan, vol. 16, No. 12 (P-1297) (5055), Jan. 13, 1992, JP-3-231274, Oct. 15, 1991.

Patent Abstracts of Japan, vol. 17, No. 277 (P-1546) (5906), May 27, 1993, JP-5-11645, Jan. 22, 1993.

*Primary Examiner*—William J. Royer
*Attorney, Agent, or Firm*—Oblon, Spivak, McClelland, Maier & Neustadt, P.C.

[57] ABSTRACT

In an image transfer device for an image forming equipment, a bias for image transfer is applied from a power source to an endless transfer belt via a bias roller. A current from the Transfer belt is released to ground via a ground electrode. Transfer control means variably controls a current $I_1$ output from the power source that the difference between the current $I_1$ and a current $I_2$ flowing from the power source to the ground via the transfer belt, i,e., $I_{out}=I_1-I_2$ remains at a preselected target current. Setting means sets the target current on the basis of a set condition or conditions.

30 Claims, 21 Drawing Sheets

| | |
|---|---|
| BELT A | $1 \times 10^7\ \Omega$ |
| BELT B | $1 \times 10^8\ \Omega$ |
| BELT C | $1 \times 10^9\ \Omega$ |

START
SET IOUT OF 40 μA
SENSE I1
I1≦300 μA ?
N
Y
I1≧150 μA ?
N
Y
END
DISPLAY "NG"
SET IOUT OF 50 μA
SENSE I1
90 μA≦I1≦180 μA ?
N
Y
END
SET IOUT OF 60 μA
SENSE I1
60 μA≦I1≦100 μA ?
N
Y
END
DISPLAY "NG"

FIG. 8A

| SET $I_{OUT}$ | VALID $I_1$ RANGE |
|---|---|
| 40 μA | 150 ~ 300 μA |
| 50 μA | 90 ~ 180 μA |
| 60 μA | 60 ~ 100 μA |

FIG. 8B

| SET $I_{OUT}$ | VALID $I_2$ RANGE |
|---|---|
| 40 μA | 110 ~ 260 μA |
| 50 μA | 40 ~ 130 μA |
| 60 μA | 0 ~ 40 μA |

START
SET Iout OF 40 μA
SENSE V
V≧1.2 KV ?
N
Y
V≦2.0KV ?
N
Y
END
DISPLAY "NG"
SET Iout OF 50 μA
SENSE V
2.0V< V≦3.2KV ?
N
Y
END
SET Iout OF 60 μA
SENSE V
3.2KV<V≦5.0KV ?
N
Y
DISPLAY "NG"
END

FIG. 11

| SET $I_{OUT}$ | VALID V RANGE |
|---|---|
| 40 μA | 1.2 ~ 2.0 KV |
| 50 μA | 2.0 ~ 3.2 KV |
| 60 μA | 3.2 ~ 4.0 KV |

FIG. 12

| | $I_{OUT}$ | $I_2$ | $I_1$ | V |
|---|---|---|---|---|
| BELT A ( $1 \times 10^7\ \Omega$ ) | 40μA | 180μA | 220μA | 1.8 KV |
| BELT B ( $1 \times 10^9\ \Omega$ ) | 40μA | 2 μA | 42μA | 3.5 KV |

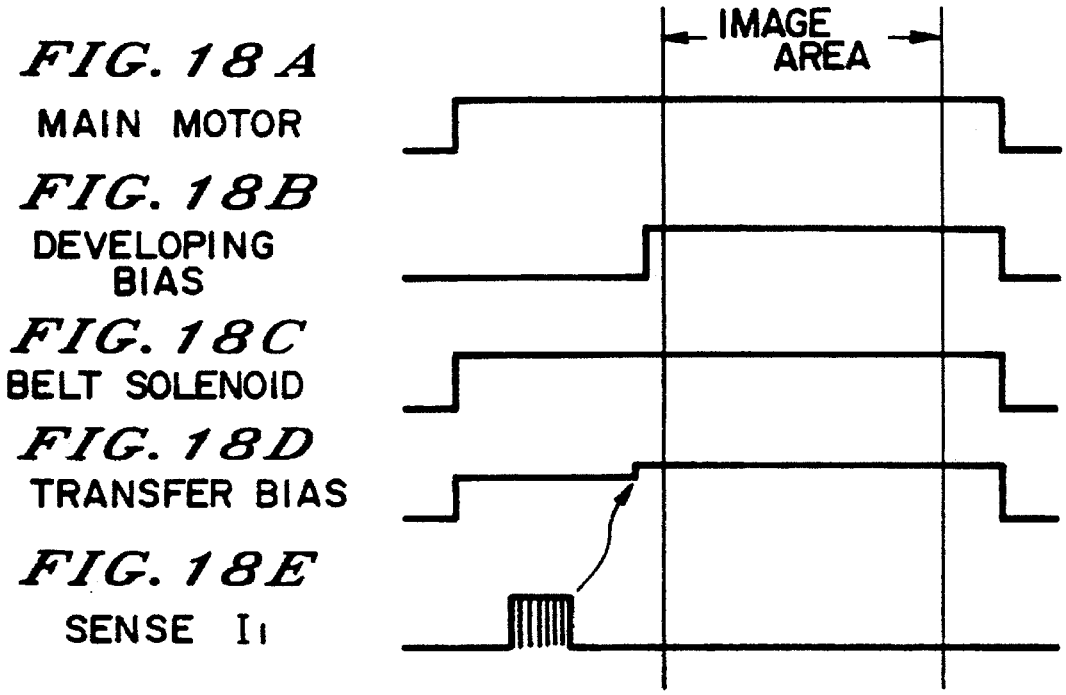
IMAGE AREA
FIG. 18A
MAIN MOTOR
FIG. 18B
DEVELOPING BIAS
FIG. 18C
BELT SOLENOID
FIG. 18D
TRANSFER BIAS
FIG. 18E
SENSE I1
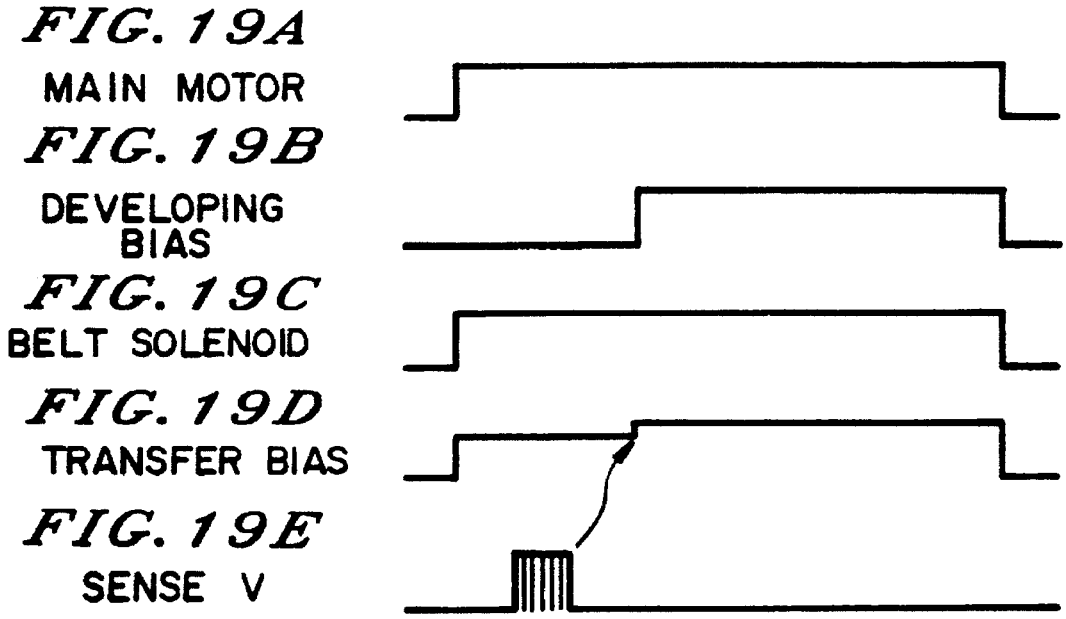
FIG. 19A
MAIN MOTOR
FIG. 19B
DEVELOPING BIAS
FIG. 19C
BELT SOLENOID
FIG. 19D
TRANSFER BIAS
FIG. 19E
SENSE V

FIG. 21

| SHEET SIZE (VERTICAL) | CORRECTION COEFFICIENT |
|---|---|
| A 3 | 1.0 |
| B 3 | 1.1 |
| A 4 | 1.5 |
| B 5 | 1.6 |
| A 5 | 1.8 |
| B 6 | 1.9 |
| A 6 | 2.0 |

FIG. 22

| SHEET SIZE (VERTICAL) | BELT A | BELT B | BELT C |
|---|---|---|---|
| A 3 | 1.0 | 1.0 | 1.0 |
| B 4 | 1.2 | 1.1 | 1.1 |
| A 4 | 1.6 | 1.5 | 1.4 |
| B 5 | 1.8 | 1.6 | 1.5 |
| A 5 | 2.0 | 1.8 | 1.6 |
| B 6 | 2.2 | 1.9 | 1.7 |
| A 6 | 2.4 | 2.0 | 1.9 |

FIG. 23

| SHEET SIZE (VERTICAL) | BELT A | BELT B | BELT C |
|---|---|---|---|
| A3 | 1.0 | 1.0 | 1.0 |
| B4 | 1.2 | 1.1 | 1.1 |
| A4 | 1.6 | 1.5 | 1.4 |
| B5 | 1.8 | 1.6 | 1.5 |
| A5 | 2.0 | 1.8 | 1.6 |
| B6 | 2.2 | 1.9 | 1.7 |
| A6 | 2.4 | 2.0 | 1.9 |

FIG. 24

| SHEET SIZE (VERTICAL) | BELT A | BELT B | BELT C |
|---|---|---|---|
| A3 | 0.9 | 1.0 | 1.0 |
| B4 | 1.1 | 1.1 | 1.0 |
| A4 | 1.5 | 1.4 | 1.3 |
| B5 | 1.7 | 1.5 | 1.4 |
| A5 | 1.9 | 1.7 | 1.5 |
| B6 | 2.0 | 1.8 | 1.6 |
| A6 | 2.2 | 1.9 | 1.8 |

IMAGE TRANSFER DEVICE FOR AN IMAGE FORMING APPARATUS

BACKGROUND OF THE INVENTION

The present invention relates to an image transfer device for a copier, printer, facsimile apparatus or similar image forming apparatus.

It is a common practice with an image forming apparatus to form an image on a photoconductive drum or similar image carrier, transfer the image from the drum to a sheet by an image transfer device, and then fix it on the sheet by a fixing device. The image transfer device may be implemented by a contact transfer scheme using, for example, a transfer belt or a non-contact transfer scheme corona discharger.

For example, Japanese Patent Laid-Open Publication No. 3-231274 (referred to as Prior Art 1 hereinafter) discloses an image transfer device using a transfer belt. The transfer belt is rotatable in contact with a photoconductive drum while a sheet is fed to a nip portion between the drum and the belt. As a transfer charge is applied from a power source to the belt via a transfer electrode contacting the belt, a toner image is transferred from the drum to a sheet being conveyed by the belt. The sheet carrying the toner image is separated from the drum and conveyed by the belt. At this instant, a controller measures a feedback current Ic flowing into the controller via a belt support roller and controls, based on the current Ic, a current Ir output from the power source such that a difference Ir–Ic has a constant value.

An image transfer device using a transfer roller is disclosed in, for example, Japanese Patent Laid-Open Publication Nos. 3-158877 and 5-11645 (referred to as Prior Arts 2 and 3 hereinafter, respectively). Prior Art 2 executes constant current control by using two different target constant currents in order to adapt to changes in environment. Specifically, a detection electrode having a plurality of different load characteristics is held in contact with the surface of the transfer roller. When a sheet is conveyed, a voltage to be applied to the transfer roller is controlled on the basis of a current flowing through the detection electrode. With this kind of approach, it is possible to maintain optimal image transfer without regard to the varying resistance or irregular resistance of the transfer roller. On the other hand, Prior Art 2 causes the current-voltage characteristic of the transfer roller relative to a photoconductive element to converge to a given point on a preselected current-voltage curve. As a result, despite the varying resistance or irregular resistance of the transfer roller, an optimal transfer voltage is determined based on a current when a voltage is changed or on a voltage when a current is changed while a sheet is not conveyed.

A prerequisite with Prior Art 1 is that the control over the transfer current by the controller be extremely accurate and stable since the transfer belt is held in contact with the drum and applied with a bias, i.e., it is different from a corona discharger which does not contact the drum. If this prerequisite is satisfied, the device can achieve stable image transfer and sheet separation adaptive to the varying environment. However, Prior Art 1 has the following issues (1) to (5) yet to be solved.

(1) Generally, use made of transfer belts having electric resistances lying a predetermined range ($\Delta 10^2$). However, with the state-of-the-art-technologies, it i s extremely difficult to confine all the belts in the predetermined range of resistance. The only way available at the present stage of development to select acceptable belts out of all the products. This, however, lowers yield to a critical level, needs extra work for selection, and increases cost. The control over the transfer current by the controller promotes stable image transfer and sheet separation against a certain degree of irregularity in the resistance of the belt itself. However, the limited allowable level also results in the yield problem.

(2) Considering world topology, temperature and humidity greatly differ depending on the district and season. Even in offices, temperature and humidity are expected to noticeably differ, for example, in the early morning, depending on the district and season. Such a difference in temperature and humidity has noticeable influence on the condition of sheets (dry or wet) and, therefore, on the resistance of the transfer belt and other members directly contributing to image transfer. Further, the irregular resistance of the belt itself, as discussed in (1) above, aggravates the change in the resistance between the transfer electrode and the drum attributable to environment. With the control over the transfer current, therefore, it is difficult to ensure stable image transfer and sheet separation against conspicuous changes in environment combined with the irregular resistance of the belt.

(3) The electric resistance of a sheet noticeably changes during the course of image formation, depending on the image forming mode selected. This occurs when an image forming cycle is repeated a plurality of times with a single sheet. Typical of such an image forming mode are a duplex mode for forming an image on both sides of a single sheet, and a combination mode for forming different images on the same side of a single sheet. In the duplex mode, the image transfer ratio is lowered during the image transfer to the rear or second side of a sheet, compared to the image transfer to the front or first side, for the following reasons. To begin with, a sheet passed through the fixing device has had the moisture thereof reduced and, therefore, has increased in electric resistance. Also, such a sheet has lost flatness and has locally curled, often resulting in an air gap (between the drum and the sheet) just before the nip portion. Further, a discharge is apt to occur due to the air gap as the resistance of the sheet increases. As a result, for a given transfer current, the image transfer rate is apt to decrease more in the event of rear image transfer than in the event of front image transfer; this is particularly conspicuous when the transfer current is great. In the particular image forming modes mentioned above, since a toner image formed on a sheet by the first image forming cycle is fixed on the sheet by heat, the moisture of the sheet is less in the event of the second image forming cycle than in the event of the first image forming cycle. As a result, the resistance of the sheet greatly differs from the first image forming cycle to the second image forming cycle. It is, therefore, difficult to ensure stable image transfer and sheet separation with the control over the transfer current.

(4) The resistance of a sheet is dependent on the kind of a sheet also, i.e., thickness (without regard to the property of a sheet) and property (ordinary sheet or OHP (OverHead Projector) sheet). This obstructs stable image transfer and sheet separation for the saint reasons as stated in (1) and (2) above. This kind of change in the resistance of a sheet is further aggravated when (1), (2) and (3), as well as (5) which will be described, are combined.

(5) The electric resistance between the transfer electrode and the drum is further changed since the area over which the electrode and drum directly contact via a sheet changes with a change in the width of a sheet. The width of a sheet depends on the size of a sheet as measured in the axial direction of the drum. For example, the width of a sheet of A3 size oriented vertically long is 297 mm while the width of a sheet of B5 size in the same orientation is 182 mm. The change in resistance translates into a change in the adequate value of the previously mentioned Ir–Ic(=$I_{out}$). The resulting relation between the sheet size and the adequate $I_{out}$ value is shown in FIG. 3. When $I_{out}$ is lower than the adequate value due to the size of a sheet, image transfer is defective. Also, when $I_{out}$ is higher than the adequate value, defective image transfer occurs since the toner is charged to opposite polarity by a discharge occurring in the gap between the sheet and the inlet side of the drum.

The change in the resistance between the transfer electrode and the drum stated above makes it difficult for the controller to promote stable image transfer and sheet separation for the same reasons as discussed in (1) and (2). This kind of change is further aggravated when (1), (2), (3) and (4) are combined.

On the other hand, Prior Art 2, using contact transfer means implemented as a transfer roller, is capable of effecting constant current control between the transfer roller and the detection electrode. However, the problem with Prior Art 2 is that the current to flow from the roller to the photoconductive element is not constant due to the influence of a difference the resistance of a sheet being conveyed in (difference thickness, difference in property between OHP sheets and ordinary sheets, and difference in moisture in the duplex mode or combination mode). As a result, the image transfer ability is affected by the condition of a sheet. Moreover, the detection electrode, contacting the transfer roller, is apt to suffer from smears due to toner particles and paper dust. In addition, when cleaning means is used to remove toner particles and paper dust from the transfer roller, defective cleaning occurs when the transfer roller wears due to the sliding contact thereof with the detection electrode.

Prior Art 3 does not maintain the transfer current constant under a condition wherein a sheet is conveyed. Hence, even in Prior Art 3, the image transfer ability is susceptible to the condition of a sheet due to tile difference in the resistance of a sheet being conveyed stated above.

SUMMARY OF THE INVENTION

It is, therefore, an object of the present invention to provide an image transfer device for an image forming apparatus which ensures stable image transfer and sheet separation without regard to the irregular electric resistance of a transfer belt, changes in environment, image forming mode selected, kind of sheets, or sheet size.

In accordance with the present invention, an image transfer device comprises an image carrier for carrying a toner image thereon, an endless transfer belt for carrying a sheet thereon and transferring the toner image from the image carrier to the sheet, a first electrode for applying a bias for image transfer to the transfer belt in contact with part of the transfer belt facing the image carrier, a second electrode contacting the transfer belt, a power source for applying the bias to the first electrode, a transfer control section for variably controlling, assuming that a current output from the power source is $I_1$, and a current to flow from the power source to the second electrode via the transfer belt is $I_2$, the current $I_1$ such that $I_1-I_2=I_{out}$ remains at a predetermined target current, and a setting section for setting the target current on the basis of a set condition.

Also, in accordance with the present invention, an image transfer device comprises an image carrier for carrying a toner image thereon, a movable transfer member contacting the surface of the image carrier for transferring the toner image from the image carrier to a transfer side, a power source for applying a bias for image transfer to the transfer member, a transfer control section for maintaining a current to be fed from the transfer member to the image carrier during image formation at a predetermined target current, a mode selecting section for selecting and inputting a desired image forming mode, and a setting section for setting the target current on the basis of a set condition.

Further, in accordance with the present invention, an image transfer device comprises an image carrier for carrying a toner image thereon, a movable transfer member contacting the surface of the image carrier for transferring the toner image from the image carrier to a transfer side, a power source for applying a bias for image transfer to the transfer member, a transfer control section for maintaining a current to be fed from the transfer member to the image carrier during image formation at a predetermined target current, a size sensing section for sensing the size of a sheet, on which an image is to be formed, as measured at least in a direction perpendicular to a sheet transport direction, and a setting section for setting the target current on the basis of a set condition.

Moreover, in accordance with the present invention, an image transfer device comprises an image carrier for carrying a toner image movable transfer member contacting the surface of the image carrier for transferring the toner image from the image carrier to a transfer side, a power source for applying a bias for image transfer to the transfer member, a transfer control section for maintaining a current to be fed from the transfer member to the image carrier during image formation at a predetermined target current, a mode selecting section for selecting and inputting a desired image forming mode, and a setting section for setting the target current on the basis of a plurality of set condition.

BRIEF DESCRIPTION OF THE DRAWINGS

The above and other objects, features and advantages of the present invention will become more apparent from the following detailed description taken with the accompanying drawings in which:

FIGS. 8A and 8B respectively show a relation between $I_{out}$ and the valid range of $I_1$ and a relation between set $I_{out}$ and the valid range of $I_2$ particular to the embodiment;

FIG. 11 tabulates a relation between set $I_{out}$ and the valid range of $I_1$ particular to the sixth embodiment;

FIG. 12 shows a relation between $I_{out}$, $I_1$, $I_2$, V and belts A and B achievable with the first embodiment;

FIG. 18 is a timing chart associated with the third embodiments;

FIG. 19 is a timing chart associated with the fourth embodiment;

FIGS. 21, 22, 23 and 24 are data tables respectively applicable to the third, fourth and fifth embodiments;

DESCRIPTION OF THE PREFERRED EMBODIMENTS

Figure 1:
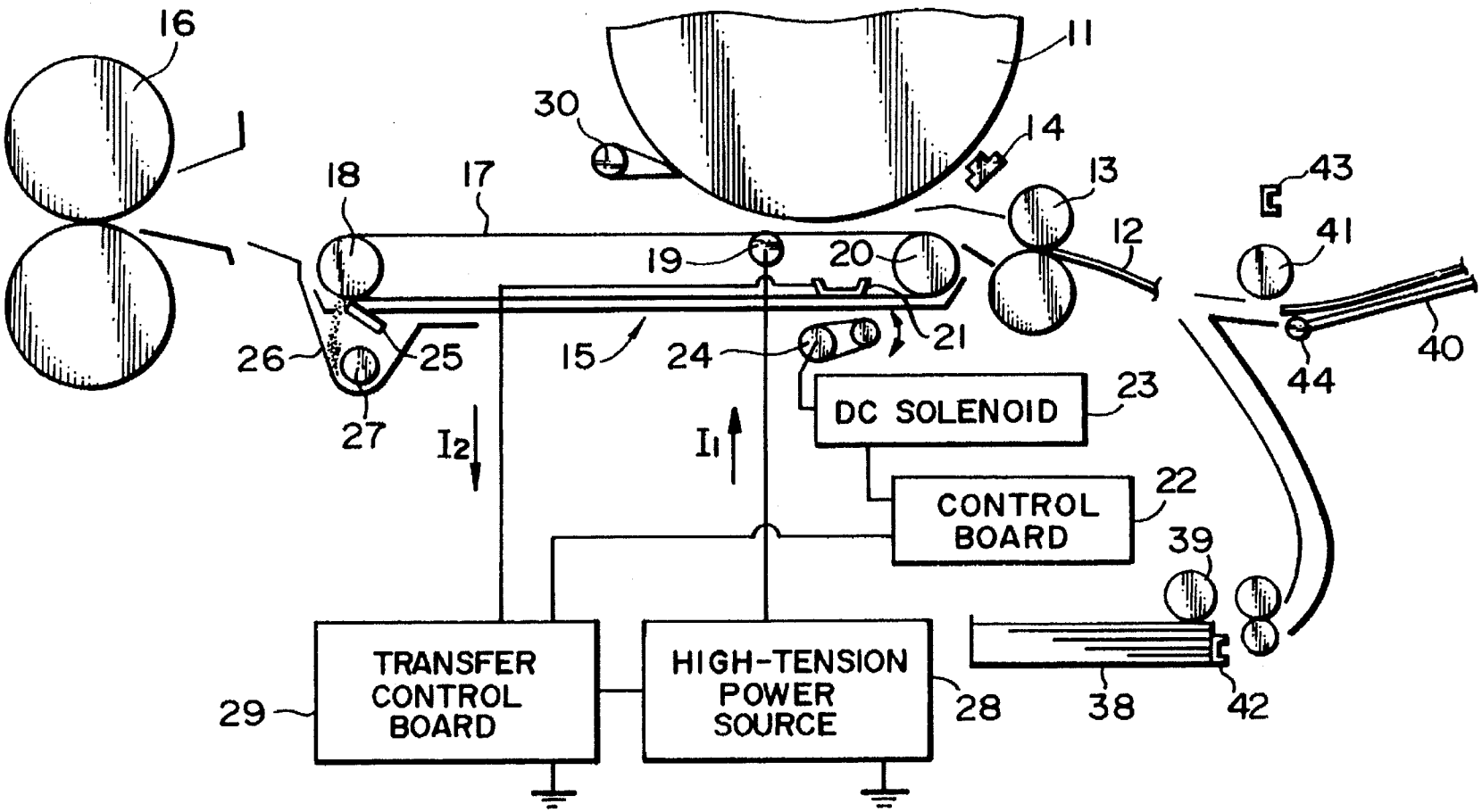
FIG. 1 is a section showing a first embodiment of the image transfer device in accordance with the present invention in a stand-by state.

Referring to FIG. 1 of the drawings, an image transfer device embodying the present invention is shown which applicable to a copier or similar image forming apparatus. As shown, the image forming apparatus includes an image 11 which is implemented as a photoconductive drum by way of example. In a simplex copy mode for forming an image on one side of a sheet, the drum 11 is rotated by a drive mechanism, not shown, and uniformly charged by a main charger, not shown. The charged surface of the drum 11 is exposed imagewise by an exposing device, not shown with the result that a latent image is electrostatically formed on the drum 11. The latent image is developed by a developing device to turn out a corresponding toner image.

A sheet 12 is fed from a sheet feed device, or tray, 38 toward a registration roller 13 by a pick-up roller 39. Alternatively, a sheet may be fed from a manual feed tray 40 toward the registration roller 13 by a pick-up roller 41. In any case, the sheet is once brought to a stop by the registration roller 13. Size sensing means 42 and 43 respectively sense the sizes of the sheets from the sheet feed device 38 and manual feed tray 40 at least in a direction perpendicular to the direction of sheet transport. The manual feed tray 40 is rotatable about a shaft 44 to an open position, as needed.

The registration roller 13 drives the sheet 12 in synchronism with the movement of the drum 11 carrying the toner image thereon. After the latent image formed on the drum 11 has been developed, the drum 11 is illuminated by a pre-transfer discharge lamp 14 to have the surface potential thereof lowered. Subsequently, an image transfer and sheet separation device 15 of the illustrative embodiment transfers the toner image from the drum 11 to the sheet 12. A fixing device 16 fixes the toner image on the sheet 12. After the image transfer, a cleaning device removes toner particles remaining on the drum 11.

In a duplex copy mode for forming an image on both sides of the sheet 12, the sheet 12 carrying the toner image on one side thereof is transported from the fixing device 16 to a duplex copy tray, not shown, along a transport path, not shown. Subsequently, the sheet 12 is refed from the duplex copy tray to the registration roller 13 while being turned over. Another toner image is transferred to and fixed on the other side of the sheet 12 in the same manner as in the simplex copy mode.

Further, in a combination copy mode for forming an image a plurality of times on the same side of the sheet 12, the sheet 12 carrying a toner image is conveyed from the fixing device 16 to the registration roller 13 via a transport path, not shown. Another toner image is transferred to and fixed on the same side of the sheet 12 by the above-stated procedure.

The image transfer and sheet separation device 15 has an endless transfer belt 17 implemented by an elastic dielectric material. The belt 17 is rotated by a drive roller 18. An electrode in the form of a bias roller 19 is held in contact with the inner periphery of the belt 17 downstream of the drum 11 with respect to the direction of rotation of the belt 17. The bias roller 19 applies a bias for image transfer to the belt 17 while the drum 11 and belt 17 are held contact over a nip width W, FIG. 2. A driven roller 20 tapered at opposite ends thereof for preventing the belt 17 from being displaced to either side. A flat ground electrode 21 is held in contact with the belt 17 to release a current from the belt 17 to ground. A DC solenoid 23 is operated by a signal from a control board 22. A lever 24 selectively moves the belt 17 into and out of contact with the drum 11 under the control of the control board 22. A cleaning blade 25 cleans the surface of the belt 17. Toner particles and paper dust removed from the belt 17 by the cleaning blade 25 are collected in a toner tray 26. A coil 27 conveys the toner and paper dust collected in the tray 26 to a bottle mounted to the apparatus body. Also shown in the figure are a high-tension power source 28 and a transfer control board 29. The belt 17 is passed over the drive roller 18 and driven roller 20.

Figure 25:
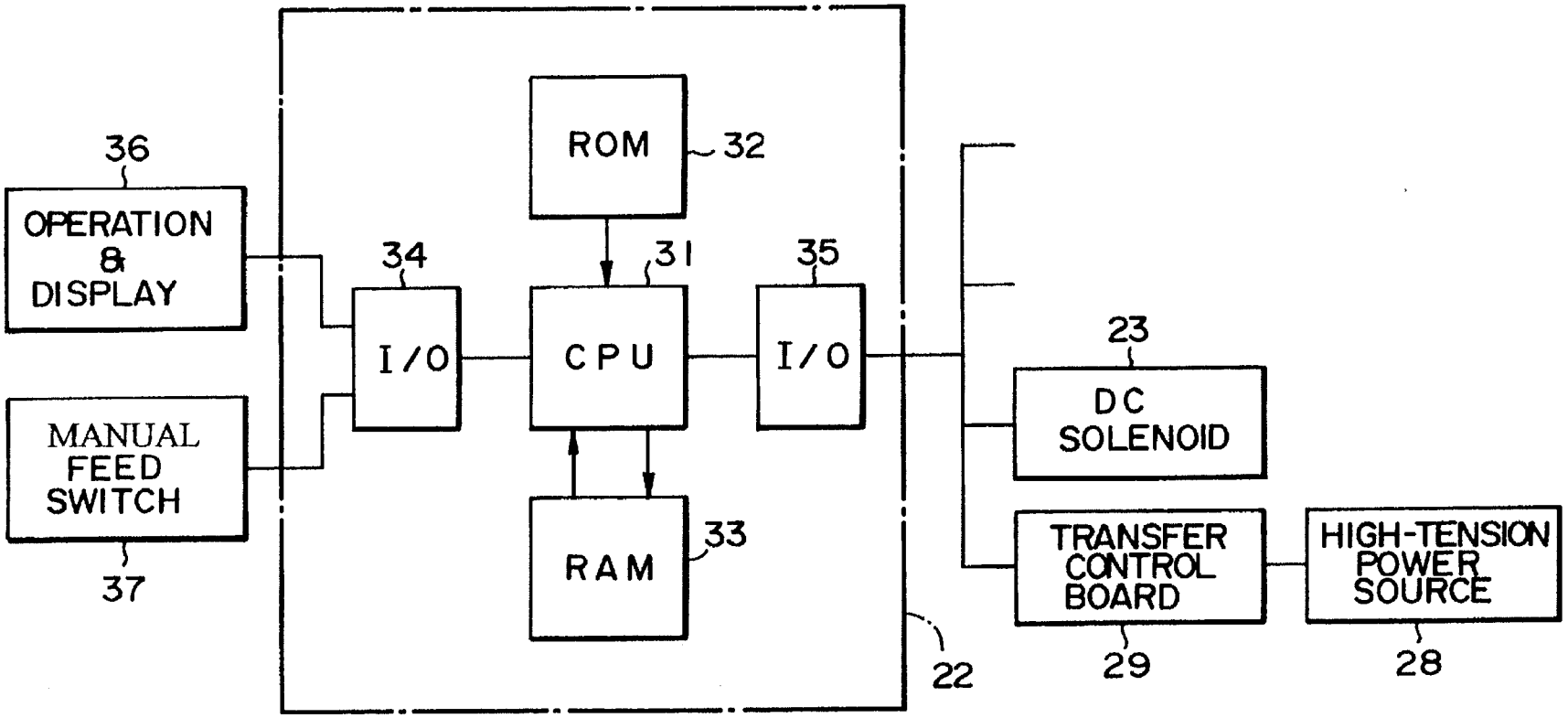
FIG. 25 is a block diagram schematically showing a specific construction of the first embodiment.

As shown in FIG. 25, the control board 22 has a CPU (Central Processing Unit) 31, a ROM (Read Only Memory) 32, a RAM (Random Access Memory) 33, and input/output (I/O) ports 34 and 35. The control board 22 receives commands from an operation and display panel 36 as well as the output of a manual feed switch 37, while causing the panel 36 to display various kinds of information thereon. Also, the control board 22 controls the operation of the embodiment by controlling the DC solenoid 23, transfer control board 29, and constituent parts of the embodiment. The manual feed switch 37 senses a sheet fed from the manual feed tray 40 by hand. The operation and display panel 36 is accessible for entering a plurality of copy modes for image formation, including the duplex copy mode and combination copy mode.

Figure 2:
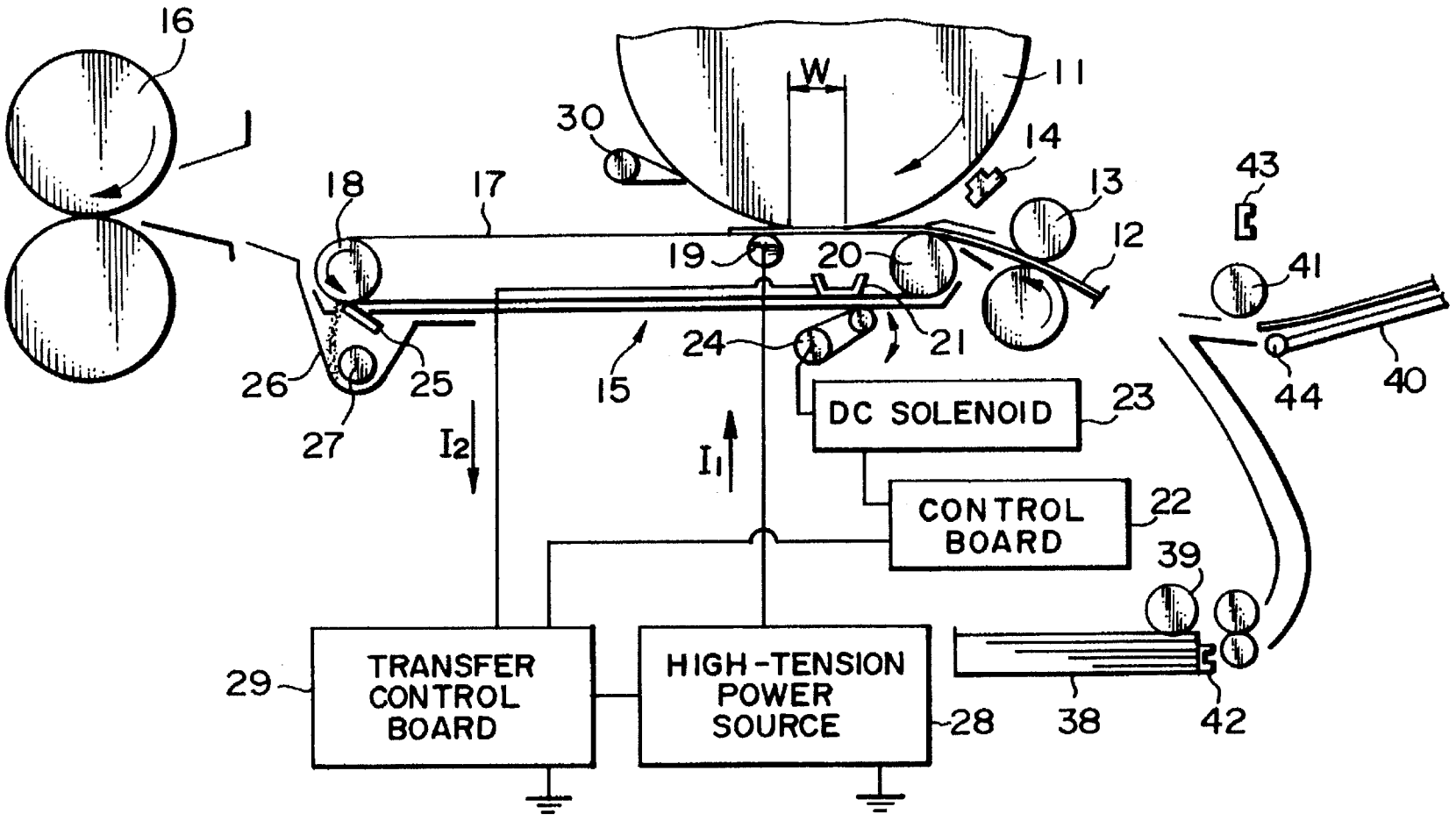
FIG. 2 is a section of the embodiment in a condition wherein a sheet is being conveyed.

As shown in FIG. 1, in a stand-by state, the belt 17 is spaced apart from the drum 11, and the high-tension power source 28 does not apply a bias to the bias roller 19. In operation, as shown in FIG. 2, the sheet 12 reached and stopped at the registration roller 13 is again driven by the roller 13 in synchronism with the movement of the drum 11 carrying a toner image thereon. As soon as the leading edge of the sheet 12 approaches the position where the drum 11 and belt 17 contact each other, the control board 22 causes the DC solenoid 23 to move the lever 24 upward. As a result, the lever 24 urges the belt 17 upward against the drum 11. At this instant, the belt 17 and drum 11 contact each other over the nip width W which is 4 mm to 8 mm wide. As the belt 17 being rotated by the drive roller 18 brings the sheet 12 to the nip portion between the belt 17 and the drum II, the power source 28 applies a bias to the bias roller 19. Consequently, a charge opposite in polarity to the charge of the toner carried on the drum 11 is deposited on the belt 17, causing the toner to be transferred from the drum 11 to the sheet 12.

The main charger, not shown, is assumed to charge the surface of the drum 11 to −800 V. After exposure, the developing device, not shown, develops the resulting latent image with a positively charged toner. Subsequently, the pretransfer discharge lamp 14 illuminates the drum 11 to power source 28 applies a bias of −1 kV to −5 kV to the bias roller 19 so as to transfer the toner from the drum 11 to the sheet 12 carried on the belt 17. It should be noted that the symbol "–(minus)" will not be attached to currents and voltages in the following description. Since the bias deposits a charge on the belt 17, the belt 17 separates the sheet 12 from the drum 11 by electrostatic adhesion while conveying it. When the separation of the sheet 12 by the belt 17 fails, a separator 30 separates the sheet 12 from the drum 11.

Figures 4, 5:
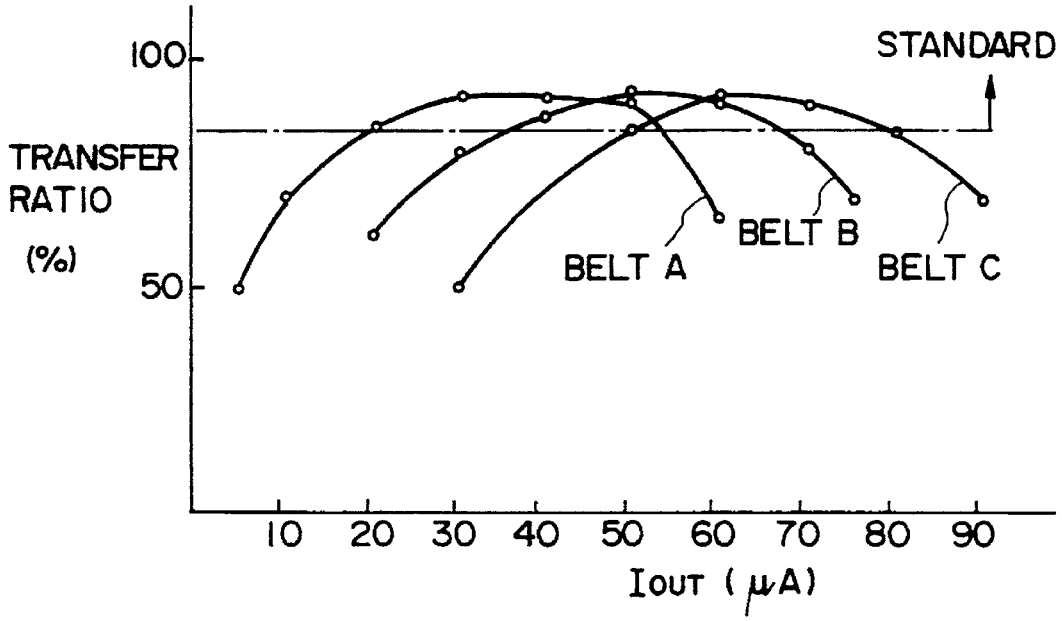
FIG. 4 is a graph indicating a relation between $I_{out}$ and image transfer ability with respect to three different kinds of transfer belts.
FIG. 5 is a table listing surface resistivities particular to the inner peripheries of transfer belts applicable to the embodiment.

As shown in FIG. 5, use is generally made of three different kinds of belts A, B and C each having a surface resistivity (as prescribed by JIS K6911) of $1\times10^9$ Ω to $1\times10^{12}$ Ω on the side thereof contacting the drum 11, and a surface resistivity of $1\times10^7$ Ω to $1\times10^9$ Ω on the side contacting the bias roller 19. The charges deposited on the belt 17 and sheet 12 are sequentially released by the ground electrode, or contact plate 21 as the belt 17 moves to the downstream side.

The outer periphery of the belt 17 is implemented by a fluorin-based material which is inherently low in coefficient of friction and, therefore, promotes stable cleaning. The outer periphery of the belt 17 is provided with a higher resistance than the inner periphery in order to obviate an occurrence that in a humid environment the rue transfer charge directly flows into the sheet 12 and thereby obstructs the separation of the sheet 12 from the drum 11. Specifically, the inner periphery of the belt 17 is covered with a 5 μm to 15 μm thick layer of chloroprene rubber, EPDM rubber, silicone rubber, epichlorohydrin rubber or similar rubber or a mixture thereof. Likewise, the outer periphery of the belt 17 is covered with a 5 μm to 15 μm thick layer of vinylidene polyfluoride, ethyrene tetrafluoride or similar fluorin-based material. These outer and inner layers of the belt 17 each contains a dispersant. On reaching the drive roller 18, the sheet 12 is separated from the belt 17 due to the elasticity thereof and then driven into the fixing device 16.

Assume that a current $I_1$ is fed from the power source 28 to the bias roller 19, and that a current $I_2$ flows from the contact plate 21 to ground. The transfer control board 29 determines the current $I_2$ on the basis of the voltage and resistance at the contact plate 21 and then controls the power source 28. i.e., current $I_1$ such that $I_1-I_2=I_{out}$ coincides with a preselected target current. In this sense, the transfer control board 29 plays the role of current sensing means for sensing the current $I_1$, setting means for setting the target current, and transfer control means for controlling the current $I_1$. In the illustrative embodiment, the belt 17 and all the members contacting it are held in an electrically floating state, so that $I_{out}$ is a current flown from the belt 17 to the drum 11 due to image transfer.

Experiments showed that the electric resistance of the belt 17 depends on the lot, aging, etc. Specifically, assume the belts A, B and C, FIG. 5, whose resistances are different by the 2 order, i.e., $1\times10^7$ Ω to $1\times10^9$ Ω. To control the resistance to such a range, carbon black, metal salt or similar conductive substance is dispersed in the belt. However, since the dispersion state slightly differs from one belt to another for production reasons, the resistance of the belt 17 is unavoidably scattered over a certain range. Moreover, when the belt is stretched during operation, the rubber and conductive material thereof change in structure, changing the resistance of the belt. The resistance also changes a little when temperature and humidity change. Hence, considering yield and changes in surrounding conditions, the use of a transfer belt whose resistance lies in a certain range is not avoidable. It follows that if $I_{out}$ is maintained constant, the image transfer ratio will be lowered. For example, assume that the belt A reached the end of the life is replaced with the belt C. Then, if $I_{out}$ is maintained at 40 μA which is desirable for the belt A in respect of image transfer ratio, the image transfer ratio available with the belt C will be short. It is, therefore, preferable that $I_{out}$ be changed to 60 μA when use is made of the belt C.

Figure 3:
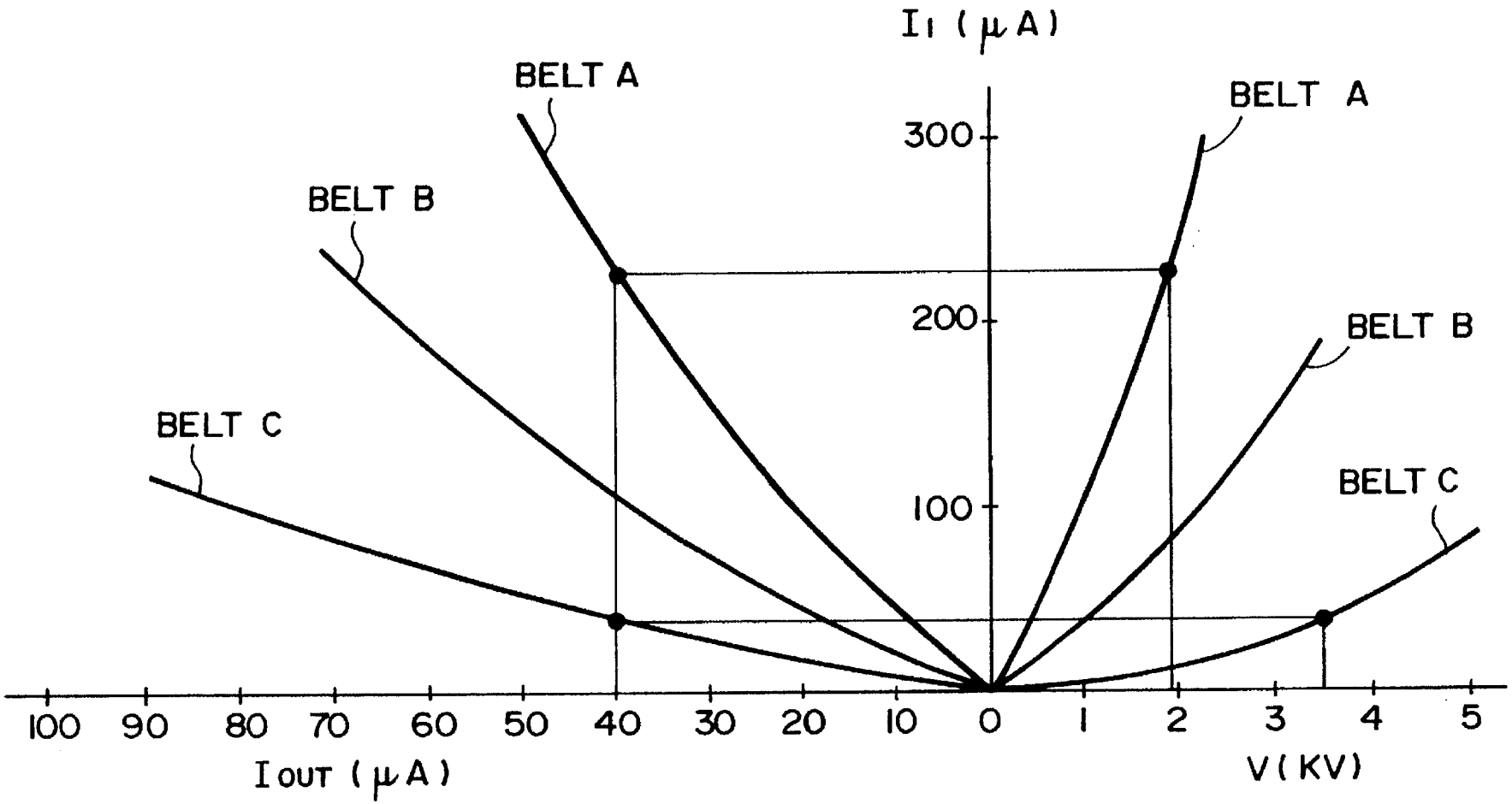
FIG. 3 is a graph showing a relation between V, $I_1$ and $I_{out}$ particular to the embodiment.

It was experimentally found that $I_{out}$, $I_1$ and the output voltage V of the power source 28 have a relation shown in FIG. 3. As shown, when $I_{out}$ is 40 μA, $I_1$ is 220 μA in the belt A, but it is only 42 μA in the belt C. This relation taught that the resistance of the belt 17 can be determined in terms of $I_1$, and selecting $I_{out}$ matching the resistance ensures high image transfer ratio, i.e., attractive images without regard to the kind of the belt 17. Alternatively, $I_{out}$ may be changed on the basis of $I_2$; $I_2$ is 180 μA in the belt A or 2 μA in the belt C.

By implementing the above principle, the embodiment broadens the allowable range of resistance of the belt 17 and, therefore, increases yield while allowing even belts susceptible to environment to be used. Further, in the duplex copy mode, when an image is to be transferred to the other or second side of the sheet 12, $I_{out}$ different from $I_{out}$ applied to the first side is set up, as will be described specifically later. This ensures high image transfer ratio at all times and is true not only in the duplex mode but also in the combination copy mode.

The belt 17 is an endless belt and, in the embodiment, comprises of a rubber belt which is 500 μm thick. When the belt 17 is pressed against the drum 11 and the difference $I_1-I_2=I_{out}$ is controlled to a constant value by the transfer control board 29, the current $I_1$ and voltage V to the bias roller 19 are determined. However, $I_1$ and V change, as shown in FIG. 3.

As shown in FIG. 3, assume the belt A (surface resistivity of $1\times10^7$ Ω) and the belt C (surface resistivity of $1\times10^9$ Ω) by way of example. Also, assume that $I_{out}$ is 40 μA. Then, to substantially cause 40 μA to flow toward the drum 11, the resistance of the belt, i.e., rubber material and the resistance of the front fluorin-based layer of the belt, both measured in the thicknesswise direction, as well as the resistance of the drum 11, make contribution. The front fluorin-based layer of the belt has a resistance as high as $1\times10^7$ Ω to $1\times10^9$ Ω even for 5 μA to 15 μA. Hence, despite the distance from the bias roller 19, the current $I_2$ flows more easily than the current $I_{out}$ due to the current flowing to the ground electrode 21 through the belt, i.e., in the belt A whose inner resistance is low. In tile belt C, since the resistance in the thicknesswise direction has no influence, the current $I_2$ decreases as the distance from the bias roller 19 increases. Here, $I_1$ and $I_2$ change, as shown in FIG. 12.

Why the voltage from the power source 28 is lower with the belt C than with the belt A is as follows. The voltage from the power source 28 depends on the lead resistance through which a current flows. Hence, in the case of the belt C, the voltage from the power source 28 is not so high despite that the inner resistance is as low as $1\times10^7$ Ω and allows a current to flow easily. However, in the case of the belt C, a current flows toward the drum 11 easily, so that tile load in the thicknesswise direction contributes. It follows that the voltage from the power source 28 increases with the belt C despite that the current $I_1$ is low due to the low resistance.

FIG. 5 lists typical surface resistivities of the inner periphery of the belt 17. As shown, the belt A has a surface resistivity of $1\times10^7$ Ω, the belt B has a surface resistivity of $1\times10^8$ Ω, and the belt C has a surface resistivity of $1\times10^9$ Ω. FIG. 3 shows a relation between $I_{out}$,$I_1$ and V.

Figure 7:
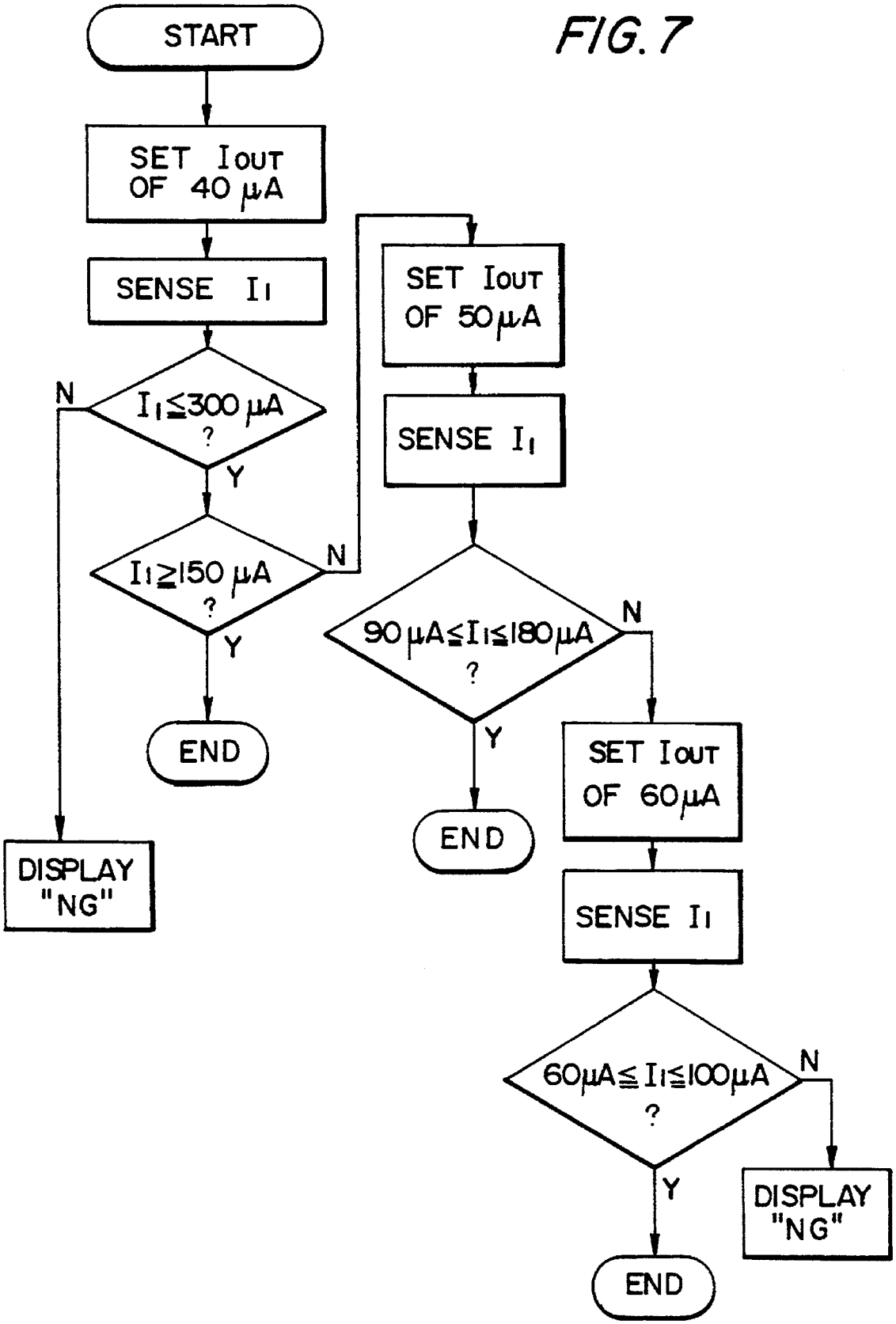
FIG. 7 is a flowchart demonstrating a specific operation of a transfer control board included in the embodiment.

Referring to FIG. 7, a specific operation of the transfer control board 29 will be described. The belt 17 is urged against the drum 11 by tile lever 24 and applied with a bias from the power source 28 via the bias roller 19. The transfer control board 29 controls the current 11 to flow from the power source 28 to the bias roller 19 such that tile difference $I_1-I_2=I_{out}$ coincides with a constant value.

To begin with, tile transfer control board 29 sets $I_1-I_2=I_{out}$ at 40 μA and then senses the current $I_1$ fed from the power source 28 to the bias roller 19. As shown in FIG. 8A, when use is made of the belt A which needs lout of 40 μA, the valid range of $I_1$ (which ensures image transfer ratios higher than a predetermined value) is from 150 μA to 300 μA. The transfer control board 29 determines whether or not the sensed $I_1$ is smaller than or equal to 300 μA. If $I_1$ is greater than 300 μA (No, FIG. 7). meaning that the resistance of the belt 17 is excessively low, the transfer control board 29 stops the operation of the apparatus or turns on, for example, a lamp to alert the user to the fact that the belt 17 cannot be used (NG).

Subsequently, the transfer control board 29 determines whether or not the sensed $l_1$ is greater than or equal to 150 μA. If the answer of this decision is negative, No, the transfer control board 29 sets $I_1-I_2=I_{out}$ at 50 μA, controls the current $I_1$ from the power source 28 to the bias roller 19 such that $I_{out}$ becomes 50 μA, and then senses the resulting $I_1$. As shown in FIG. 8A, when use is made of the belt B needing $I_{out}$ of 50 μA, the valid range of $I_l$ is from 90 μA to 180 μA. Hence, the transfer control board 29 determines whether or not the sensed $I_1$ lies in a range of 90 μA≦$I_1$≦180 μA. If the answer of this decision is negative, No, the transfer control board 29 sets $I_{out}$ at 60 μA and controls $I_1$ such that $I_{out}$ becomes 60 μA.

The control described above is effected when the power switch of the apparatus is turned on for the first time in the morning, i.e., when the drum 11, belt 17 and other members are in preliminary rotation. More specifically, when the drum 11 and belt 17 are in contact and in rotation without any sheet passed therethrough, the control board 22 turns on the power source 28 at a predetermined time. This is followed by the procedure shown in FIG. 7.

To execute the control, the transfer control board 29 samples ten $I_1$ data every 5 milliseconds,discards the greatest and smallest values, and then produces a mean of the remaining eight data, thereby determining $I_1$. Sampling ten $I_1$ data successfully compensates for the resistance of the belt 17 which differs from one point to another point. It should be noted that the control timing and the arithmetic operation with data described above may be modified in various ways. For example, the control may be executed every time a predetermined number of copies are produced so as to cope with aging more delicately.

As shown in FIG. 8A, for the belt C needing $I_{out}$ of 60 μA, the valid range of $I_1$ is from 60 μA to 100 μA. Then, the transfer control board 29 senses the current $I_1$ from the power source 28 to the bias roller 19 to see if it lies in a range of 60 μA≦I1≦100 μA. If the answer of this decision is negative, No, the board 29 stops the operation of the apparatus or turns on, for example, a lamp to alert the user to the unusable belt (NG).

In the illustrative embodiment, the optimal experimental conditions are that the drum 11 and belt 17 be rotated at a linear velocity of 330 mm/sec, that the belt 17 be 334 mm long, that the drum 11 be 100 mm in diameter, that the drive roller 18 be 16 mm in diameter, and that a sheet of A3 size (or a sheet of A4 size oriented horizontally long) be passed. In the other conditions, although the current range and set transfer current vary, the same effect is achievable based on the same principle. While the transfer control board 29 senses $I_1$ in the above specific operation, it may sense $I_2$. In such a case, as shown in FIG. 8B, when use is made of the belt A needing $I_{out}$ of 40 μA, the valid range of $I_2$ is from 110 μA to 260 μA; for the belt B needing $I_{out}$ of 50 μA, the valid range is from 40 μA to 130 μA; and for the belt C needing $I_{out}$ of 60 μA, the valid range is from 0 μA to 40 μA. Therefore, the transfer control board 29 will determine whether or not sensed $I_2$ lies in the 110 μA to 260 μA range, 40 μA to 130 μA range or 0 μA to 40 μA range and controls $I_{out}$ to 40 μA, 50 μA or 60 μA or stops the operation of the apparatus.

As stated above, by changing $I_{out}$ on the basis of $I_1$ or $I_2$, there can be ensured a high image transfer ratio and, therefore, attractive images at all times. Moreover, the range of resistance available with the belt 17 as a part of the apparatus is broadened. This increases the yield of the belts 17, reduces cost, and enhances adaptability to environment. The transfer control board 29 has been shown and described as changing $I_{out}$ when the sheet 12 is not present between the belt 17 and the drum 11. Alternatively, the board 29 may change it when the sheet 12 is present between the belt 17 and the drum 11. In addition, since the board 29 determines whether or not the belt 17 is usable, a defective belt 17 can also be detected beforehand when installed in the apparatus.

Figure 9:
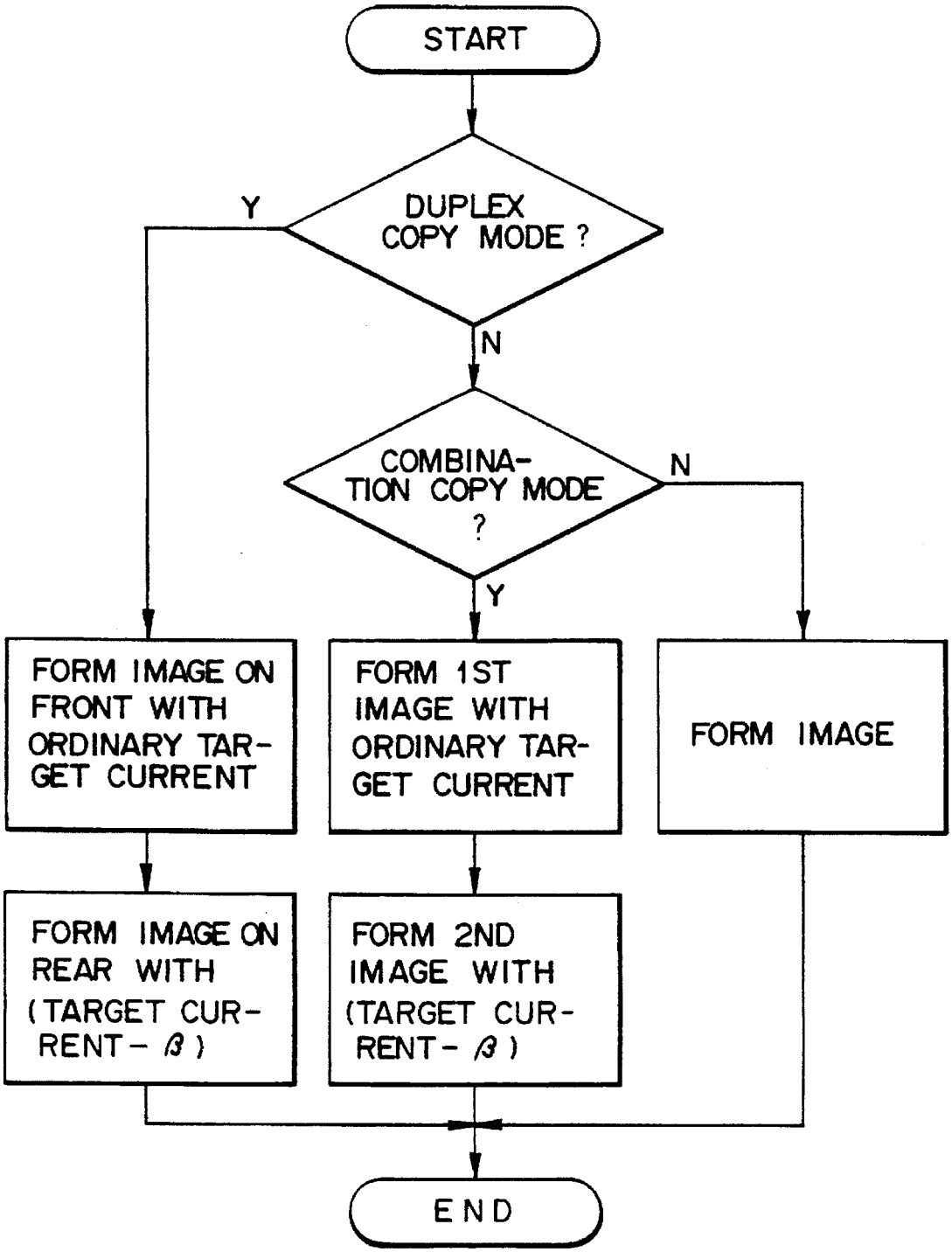
FIG. 9 is a flowchart representing a specific operation of the embodiment.

Assume that the apparatus has the power switch thereof turned on for the first time in the morning and performs a preparatory operation. Then $I_{out}$ changes thereafter without regard to $I_1$ or $I_2$, depending on the copying conditions, copy mode, sheet size, etc. When the belt 17 is implemented by the belt B, i.e., when $I_{out}$ is 50 μA, the transfer control board 29 determines, in response to the output of the control board 22, whether or not the duplex copy mode has been selected, as shown in FIG. 9. If the duplex copy mode has not been selected, an image forming (copying) cycle is executed. In the duplex copy mode as entered on the operation and display panel 36, the board 29 sets $I_{out}$ having an ordinary target value for the front of the sheet 12 and controls $I_l$ such that $I_{out}$ coincides with the ordinary target value.

Figure 6:
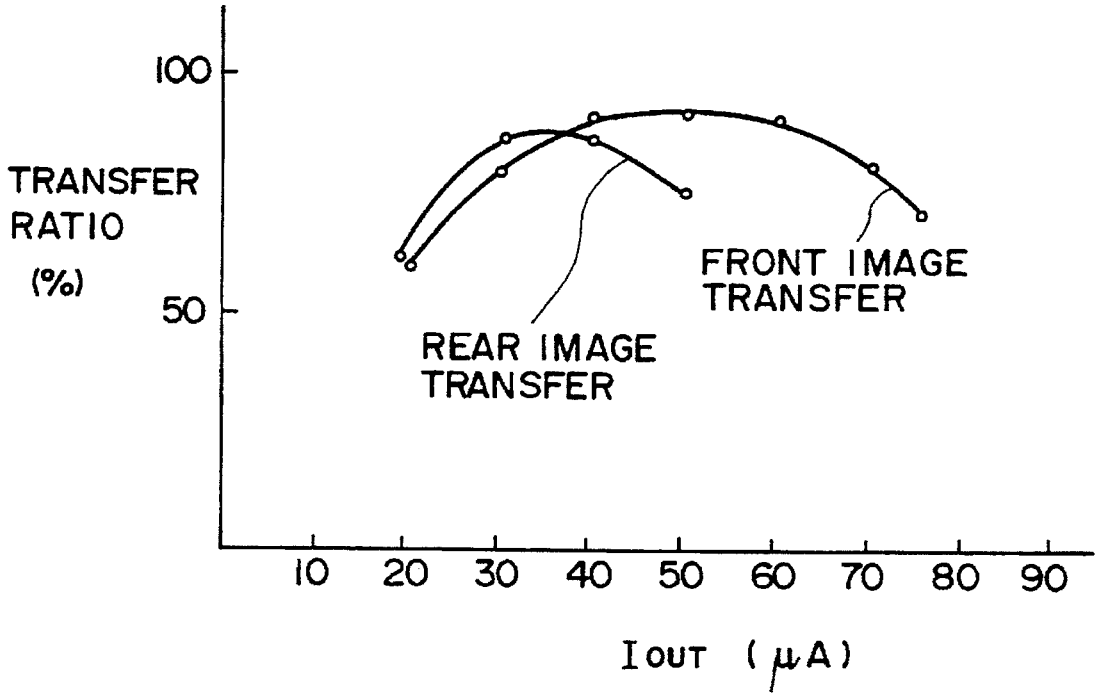
FIG. 6 is a graph showing a relation between $I_{out}$ and image transfer ability to hold in an image forming apparatus in the event of front image transfer and rear image transfer.

In the event of image transfer to the rear of the sheet 12, the ordinary target value would lower the image transfer ratio, as shown in FIG. 6, for the following reasons. To begin with, a sheet passed through the fixing device has had the moisture thereof reduced and, therefore, has increased in resistance. Also, such a sheet has lost flatness and h a s locally curled, often resulting in an air gap (between the drum 11 and the sheet 12) just before the nip portion. Further, a discharge is apt to occur due to the air gap as the resistance of the sheet increases. As a result, for a given transfer current, the image transfer rate is apt to decrease more in the event of rear image transfer than in the event of front image transfer; this is particularly conspicuous when the transfer current is great. In light of this, the transfer control board 29 determines an image forming mode selected in response to a signal from the operation panel 36. In the duplex copy mode, when an image is to be transferred to the rear of the sheet 12, the board 29 sets $I_{out}$ smaller than the ordinary target current by β before switching the transfer bias, e.g., when the sheet 12 begins to be refed from the duplex copy tray. Then, the board 29 controls $I_1$ such that $I_{out}$ coincides with the predetermined target current. This ensures a high image transfer ratio and, therefore, attractive images even in the duplex copy mode.

In the combination copy mode as indicated by the signal from the operation panel 36, when an image is to be transferred to the front of the sheet 12 for the first time, the transfer control board 29 sets $I_{out}$ at the ordinary target current and controls $I_1$ such that $I_{out}$ coincides therewith. When another image is to be transferred to the front of the sheet 12, the board 29 sets $I_{out}$ smaller than the ordinary target current by β before switching the transfer bias, e.g., when the sheet 12 is conveyed toward the registration roller 13. Then, the board 29 controls $I_1$ such that $I_{out}$ coincides with the predetermined target current. This ensures a high image transfer ratio and, therefore, attractive images in the combination copy copy mode.

When the manual feed tray 40 is opened about the shaft 44 by hand, the nanual feed switch 37 senses it and feeds the resulting output thereof to the control board 22. In response, the control board 22 sets up a manual image forming mode and changes $I_{out}$ to the value implemented the second image transfer in the duplex copy mode or combination copy mode.

When the manual feed tray 40 is closed, the control board 22 detects it in response to the output of the manual feed switch 37. Then, the board 22 cancels the manual image forming mode and restores the $I_{out}$ value set up before the opening of the tray 40. This is because the tray 40 is often used to feed OHP sheets, thick sheets and other special sheets. Of course, the tray is usable to feed ordinary sheets. Therefore, the duplex copy mode and combination copy mode, for example, may be installed in the apparatus as serviceman modes which allow a serviceman to change the set conditions as needed by the user. Then, in the initial setting of the apparatus, the control board 22 will not change $I_{out}$ even when the manual feed tray 40 is used. Specifically, for a user who uses the tray 40 to feed only special sheets, there may be called a program stored in the ROM 32 and which allows the control board 22 to change $I_{out}$ in response to a signal from the operation panel 36 which indicates the use of the tray 40.

Alternatively, an exclusive key may be provided on the operation panel 36 and assigned to OHP sheets, thick sheets and other special sheets. In this case, a person intending to use such a special sheet presses the exclusive key. The resulting signal, indicative of a special sheet mode, is sent from the operation panel 36 to the control board 22. In response, the control board 22 sets up $I_{out}$ for the previously stated second image formation in the duplex copy mode or combination copy mode. The signal indicative of the special sheet mode will be cancelled when, for example, the exclusive key is pressed again or when the image forming cycle in the special sheet mode is repeated a number of times corresponding to the desired number of copies. Then, the control board 22 will restore $I_{out}$ set up before the depression of the exclusive key.

Assume that the belt 17 is implemented by the belt A, and that $I_{out}$ of 40 μA is set. Then, in the duplex copy mode, the transfer control board 29 sets ordinary $I_{out}$ of 40 μA for the front of the sheet 12, but for the rear of the sheet 12 the board 29 changes it to an adequate value which maintains the image transfer ratio without entailing a discharge or similar fault. When the belt 17 is implemented by the belt C and $I_{out}$ is 60 μA, the board 29 sets, in the duplex copy mode, ordinary $I_{out}$ of 60 μA for the front of the sheet 12, but for the rear of the sheet 12 the board 29 changes it to an adequate value which maintains the image transfer ratio without entailing a discharge or similar fault.

As stated above, the embodiment ensures stable image transfer and sheet separation without regard to the irregular resistance of the belt 17, changes in environment, or the kind of sheets. The resistance range of the belt 17 is broadened as a constituent part of the apparatus, increasing yield and reducing cost. In addition, the stable image transfer and sheet separation are not affected by the image forming mode selected.

Figure 13:
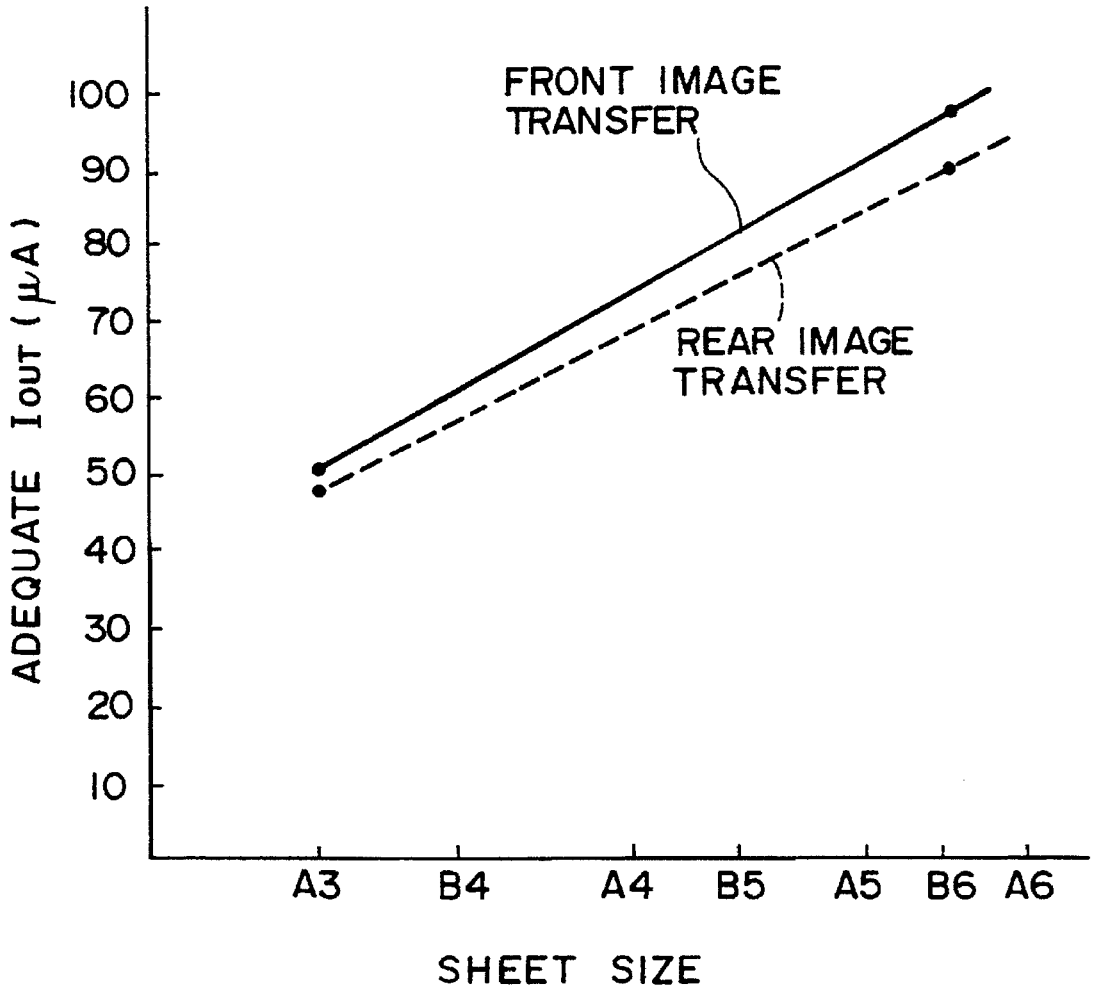
FIG. 13 is a graph showing a relation between sheet size and adequate $I_{out}$ in a duplex copy mode available with a copier.
Figure 14:
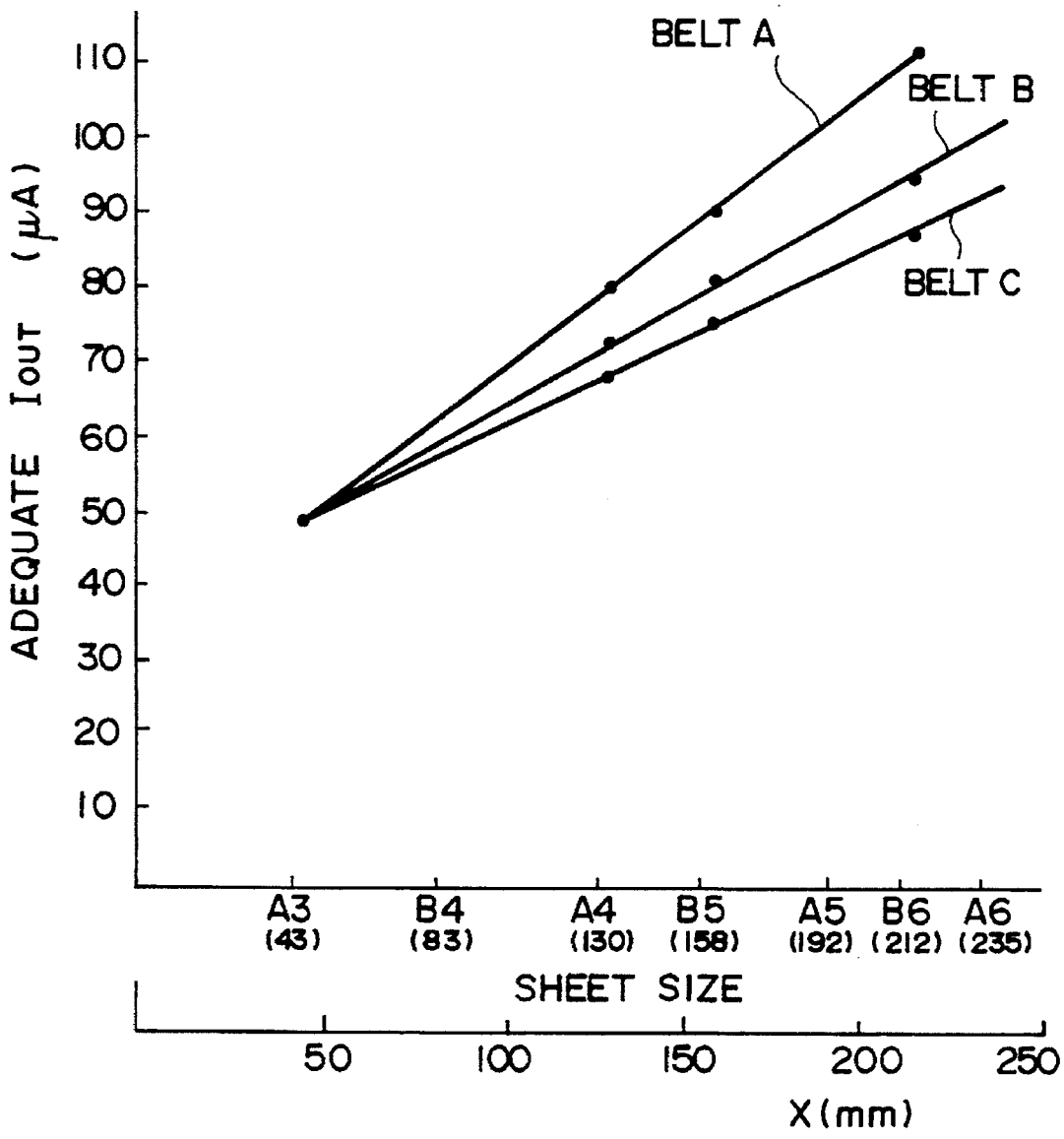
FIG. 14 is a graph showing a relation between sheet size and adequate $I_{out}$ with respect to three different kinds of transfer belts.

FIG. 13 shows an experimental relation between sheet size and adequate $I_{out}$ as determined when the duplex copy mode was effected with the belt B. Likewise, FIG. 14 shows an experimental relation between sheet size and adequate $I_{out}$ as determined with each of the belts A, B and C. It will be seen that the area over which the drum 11 and electrode 19 contact with the intermediary of the sheet 12 change depending on the width of the sheet 12, so that the electric resistance between the drum 11 and the electrode 19 changes with a change in sheet size. As a result, adequate $I_{out}$ depends on the sheet size. Further, the relation between $I_{out}$ and image transfer ratio depends on the resistance of the belt A, B or C, as shown in FIG. 4. A second to a fourth embodiment to be described each corrects $I_{out}$ according to sheet size and/or the resistance of the belt.

Two different methods are available for determining the resistance of the transfer belt, as follows.

(1) When $I_{out}$ is set at 40 μA, $I_1$ is 220 μA for the belt A or 42 μA for the belt C, as shown in FIG. 3. Hence, the resistance level of the belt is determined in terms of $I_1$ derived from $I_{out}$.

(2) When $I_{out}$ is set at 40 μA, the voltage applied from the power source 28 to the belt 17 via the electrode 19 is 1.6 kV for the belt A or 3.5 kV for the belt C, as shown in FIG. 3. Hence, the resistance level of the bell is determined in terms of the voltage V derived from $I_{out}$.

Figure 15:
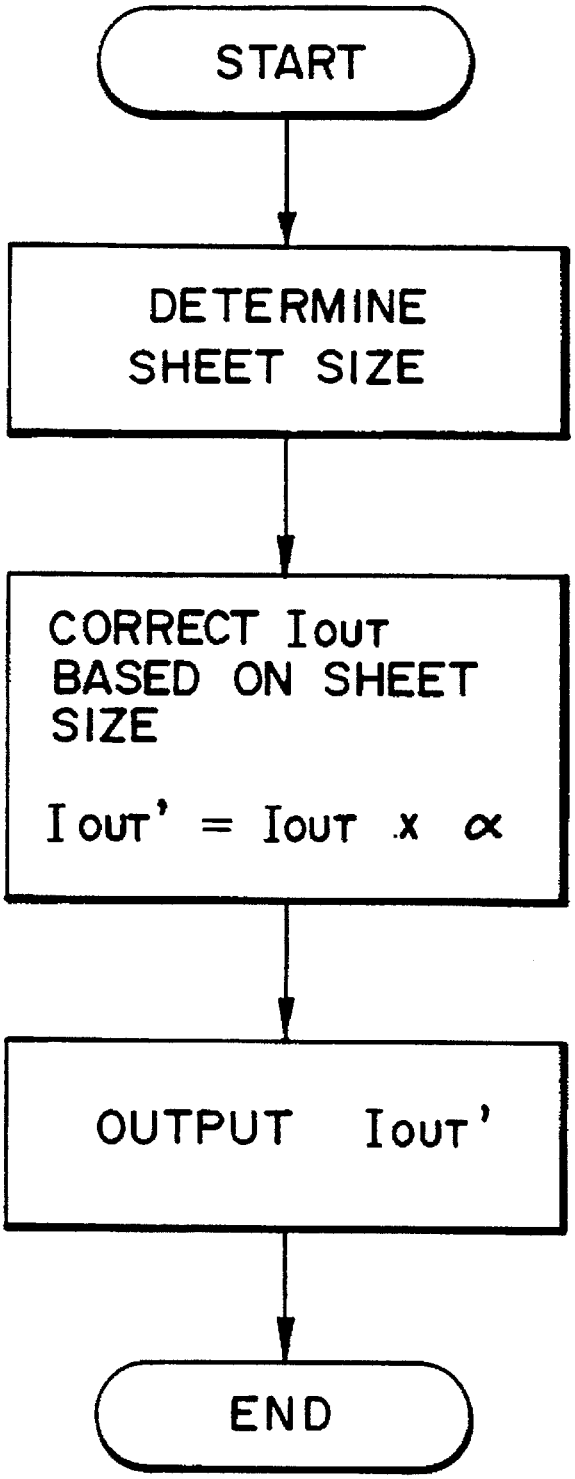
FIGS. 15, 16 and 17 are flowcharts respectively demonstrating specific operations of a second, third and fourth embodiment of the present invention.

In a second embodiment of the present invention, the transfer control board 29 monitors a sheet size in place of the current $I_1$ and sets the difference $I_{out}$ based on the sheet size. This embodiment is similar to the first embodiment except that the transfer control board 29 executes another specific operation shown in FIG. 15. As shown in FIG. 15, the control board 22 determines, in response to the outputs of the sensing means 42 and 43, the size of a sheet to be fed to the nip portion and sends the resulting data to the transfer control board 29. In response, the transfer control board 29 corrects $I_{out}$ with a correction coefficient α, i.e., performs $I'_{out}=I_{out}\times\alpha$ On the basis of the sheet size and then sets $I'_{out}$ as a new target current.

The relation between the sheet size and the correction coefficient α is determined by experiments and stored in the ROM 32 as a data table. FIG. 21 shows a data table for the belt B specifically. As shown, the correction coefficient α has a reference value which is 1.0 assigned to A3 size. The correction coefficient α is representative of a ratio between adequate $I_{out}$ for A3 size and the target current which provides adequate $I_{out}$ for each sheet size.

Assume that the belt B is used, and that $I_{out}$ of 50 μA is set. Then, the transfer control board 29 performs, if the sheet size is A4, $I'_{out}$=50 μA×1.5=75 μA, where 1.5 is the coefficient α, and sets $I'_{out}$ as a new target current. For a sheet of B6 size, the board 29 performs $I'_{out}$=50 μA×1.9=95 μA and sets $I'_{out}$ as a new target current.

As shown in FIG. 18, when the belt 17 is urged against the drum 11 by the solenoid 23, the power source 28 applies a bias such that Iout has the reference value. Before a sheet from the registration roller 13 reaches the nip portion and the image on the drum 11 arrives at the nip portion, the detection of 11 and the setting of the target current are completed. The bias is turned off after the image on the drum 11 has moved away from the nip portion. Hence, the resistance of the belt 17 is detected on a real time basis without being influenced by the sheet.

The second embodiment described above achieves advantages comparable with the advantages stated in relation to the first embodiment.

Figure 16:
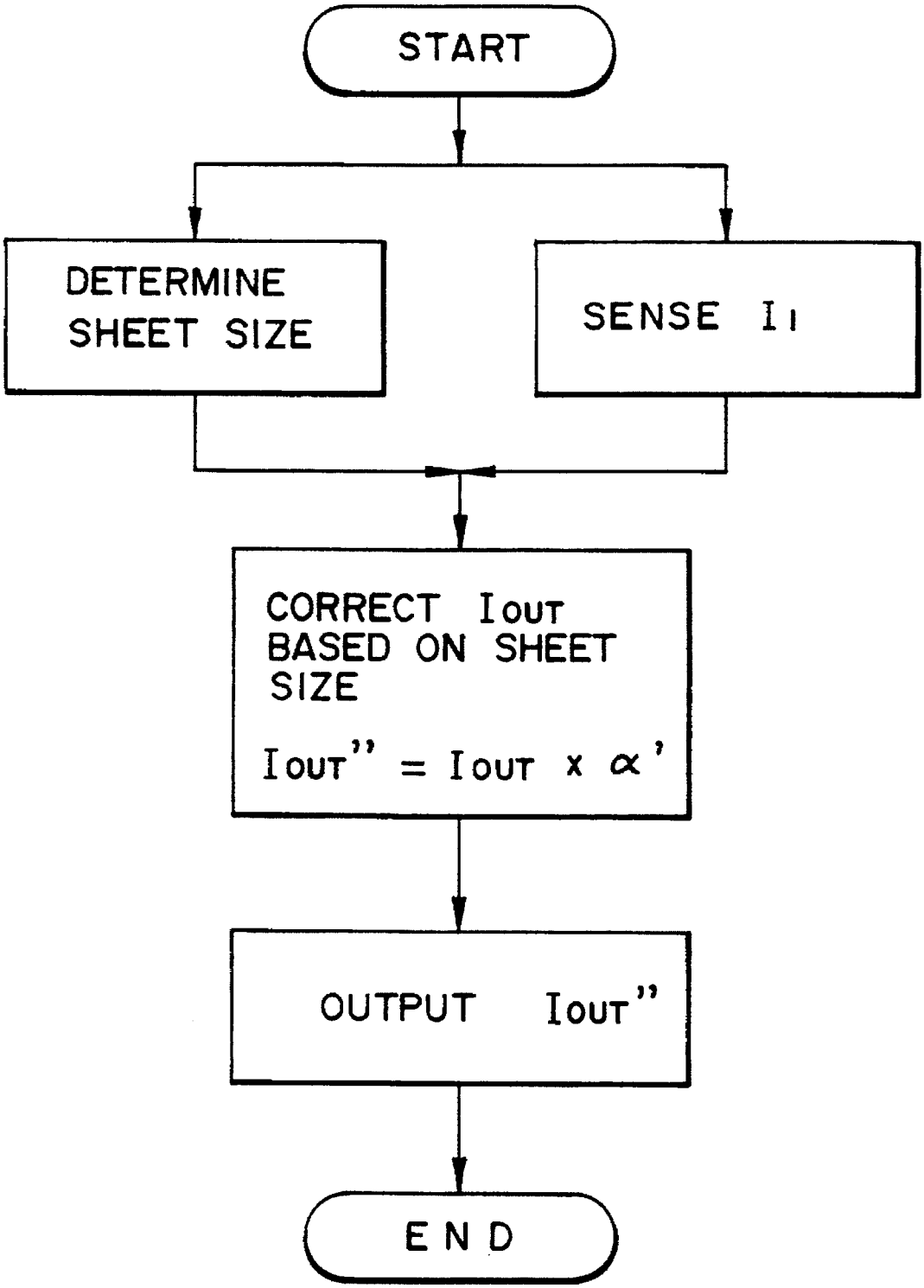

A third embodiment to be described hereinafter is similar to the first embodiment except that the transfer control board 29 executes another specific procedure shown in FIG. 16. As shown, the control board 22 determines, in response to the outputs of the size sensing means 42 and 43, the size of a sheet to be fed to the nip portion and sends the resulting data to the transfer control board 29. In response, the transfer control board 29 determines the resistance of the belt 17 in terms of the sensed current $I_1$ by the above stated method (1) before the sheet from the registration roller 13 arrives at the nip portion and while the belt 17 is in contact with the drun 11. As a result, the board 29 sees the kind of the belt 17, i.e., belt A, B or C. Assuming that $I_{out}$ of 50 μA is set by way of example, the board 29 determines, if the sensed current $I_1$ is 300 μA, that the belt 17 is the belt A or determines, if $I_1$ is 51 μA, that the belt 17 is the belt C.

The transfer control board 29 corrects $I_{out}$ with a correction coefficient α', i.e., performs $I''_{out}=I_{out}\times\alpha'$ in matching relation to the sheet size and the kind of the belt 17 (A, B or C). Then, the board 29 sets $I'_{out}$ as a new target current.

The relation between the sheet size and kind of the belt (A, B or C) and the correction coefficient α' is determined by experiments and stored in the ROM 32 as a data table, as shown in FIG. 22. As shown, the correction coefficient α' has a reference value which is 1.0 assigned to A3 size. The correction coefficient α' is representative of a ratio between the adequate current $I_{out}$ for A3 size and the target current which provides adequate $I_{out}$ for each sheet size and belt (A, B or C).

Assume that $I_{out}$ of50 μA is set, that the belt A is used, and that the sheet size is A4. Then, the transfer control board 29 performs $I''_{out}$=50 μA×1.6=80 μA, where 1.6 is the correction coefficient α', and sets $I''_{out}$ as a new target current. When the belt C is used and the sheet size is A4, the board 29 performs $I''_{out}$=50 μA×1.4=70 μA and sets $I''_{out}$ as a new target current.

As shown in FIG. 18, when the belt 17 is urged against the drum 11 by the solenoid 23, the power source 28 applies a bias such that Iout has the reference value, as in the second embodiment. Before a sheet from the registration roller 13 reaches the nip portion and the image on the drum 11 arrives at the nip portion, the detection of I1 and the setting of the target current are completed. The bias is turned off after the image on the drum 11 has moved away from the nip portion.

With the third embodiment described above, it is possible to transfer an image and separate a sheet stably without regard to the irregular electric resistance of the belt 17, changes in environment, the kind of sheet, or sheet size.

Figure 17:
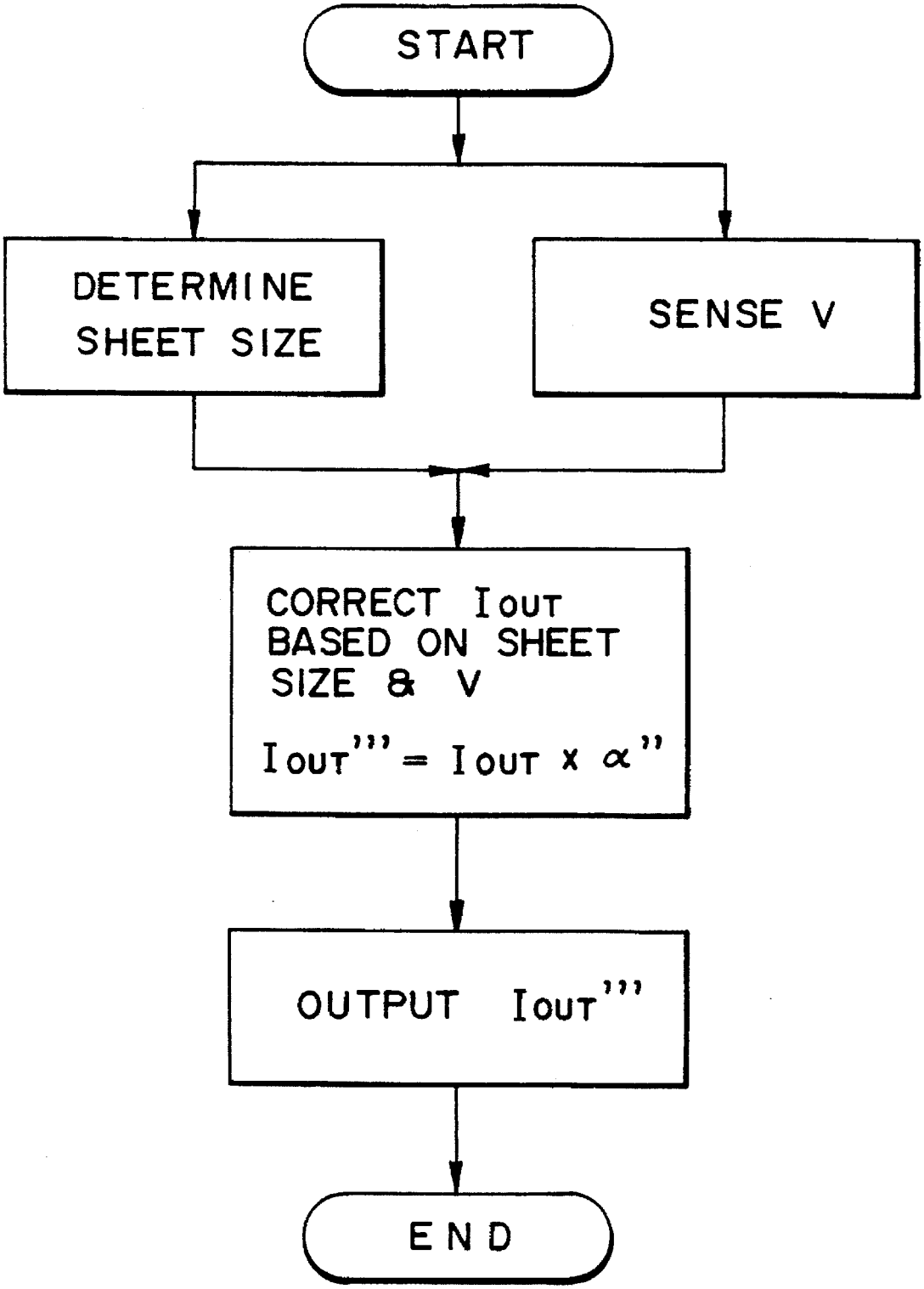

FIG. 17 shows a specific procedure representative of a fourth embodiment of the present invention. This embodiment is similar to the first embodiment except for the substitution of FIG. 17 for FIG. 7. As shown, the control board 22 determines, in response to the outputs of the sheet sensing means 42 and 43, the size of a sheet to be fed to the nip portion and sends the resulting data to the transfer control board 29. In response, the transfer control board 29 determines the resistance of the belt 17 in terms of sensed V by the previously stated method (2) before the sheet from the registration roller 13 arrives at the nip portion and while the belt 17 is in contact with the drum 11. As a result, the board 29 sees the kind of the belt 17, i.e., belt A, B or C. Assuming that $I_{out}$ of 50 μA is set by way of example, the board 29 determines, if sensed V is 1.7 kV, that the belt 17 is the belt A or determines, if sensed V is 4.0 kV, that the belt 17 is the belt C.

The transfer control board 29 corrects $I_{out}$ with a correction coefficient α", i.e., performs $I_{out}=I_{out}\times\alpha''$ in matching relation to the sheet size and the kind of the belt 17 (A, B or C). Then, the board 29 sets $I''_{out}$ as a new target current.

The relation between the sheet size and kind of the belt (A, B or C) and the correction coefficient α" is determined by experiments and stored in the ROM 32 as a data table, as shown in FIG. 23. As shown, the correction coefficient α" has a reference value which is 1.0 assigned to A3 size. The correction coefficient α" is representative of a ratio between the adequate current $I_{out}$ for A3 size and the target current which provides adequate Iout for each sheet size and belt (A, B or C).

Assume that $I_{out}$ of 50 μA is set, that the belt A is used, and that the sheet size is A4. Then, the transfer control board 29 performs $I''_{out}$=50 μA×1.6=80 μA, where 1.6 is the correction coefficient α", and sets $I'''_{out}$ as a new target current. When the belt C is used and the sheet size is A4, the board 29 performs $I''_{out}$=50 μA×1.4=70 μA and sets $I''_{out}$ as a new target current.

As shown in FIG. 19, when the belt 17 is urged against the drum 11 by the solenoid 23, the power source 28 applies a bias such that Iout has the reference value. Before a sheet from the registration roller 13 reaches the nip portion and the image on the drum 11 arrives at the nip portion, the detection of V and the setting of the target current are completed. The bias is turned off after the image on the drum 11 has moved away from the nip portion. Hence, the resistance of the belt 17 is detected on a real time basis without being affected by the sheet.

With the fourth embodiment described above, it is possible to transfer an image and separate a sheet stably without regard to the irregular electric resistance of the belt 17, changes in environment, the kind of sheet, or sheet size.

Figure 20:
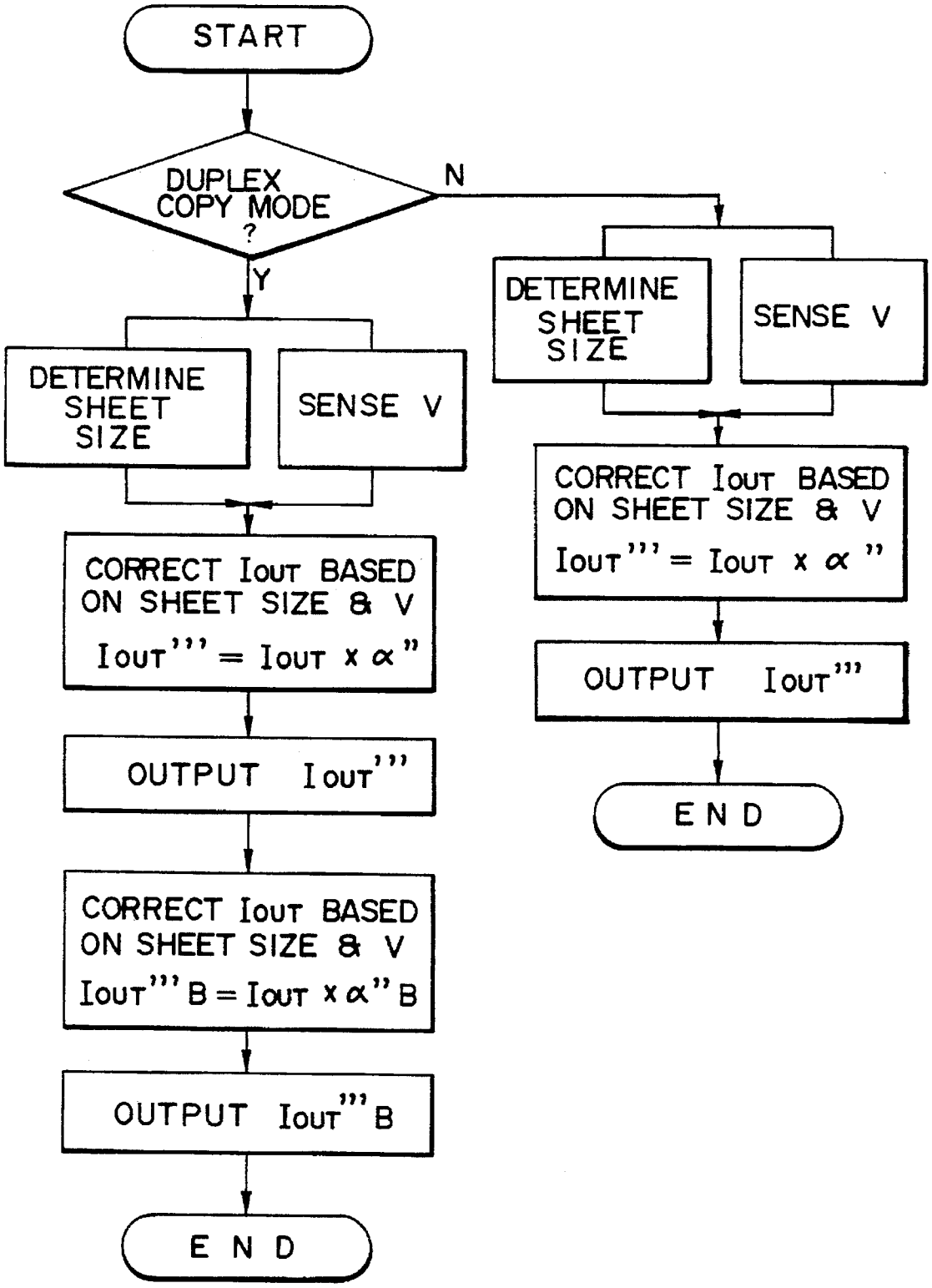
FIG. 20 is a flowchart showing a specific operation representative of a fifth embodiment of the present invention.

A fifth embodiment to be described is similar to the first embodiment except that the transfer control board 29 executes another specific procedure shown in FIG. 20. As shown, in response to the output of the control board 22, the transfer control board 29 determines whether or not the duplex copy mode has been selected. If the duplex copy mode has not been selected, the board 29 sets a target current matching the sheet size and V, as in the fourth embodiment.

When the duplex copy mode is set up, the transfer control board 29 sets, in the event of the front or first image transfer, a target current matching the sheet size and V, as in the fourth embodiment. Then, in the event of the rear or second image transfer, the board 29 detects V before the sheet from the registration roller 13 enters the nip portion and while the belt 17 and drum 11 are in contact. Based on detected V, the board 29 determines the resistance of the belt 17 by using the previously stated method (2), thereby determining the kind of the belt 17 (A, B or C). Subsequently, the board 29 corrects $I_{out}$ with a correction coefficient α"B, i.e., performs $I''_{out}tB=I_{out}\times\alpha''B$ in matching relation to the sheet size and the kind of the belt 17 (A, B or C). Then, tire board 29 sets $I''_{out}$ B as a new target current.

The relation between the sheet size and kind of the belt (A, B or C) and the correction coefficient α"B is determined by experiments and stored in the ROM 32 as a data table, as shown in FIG. 24. As shown, the correction coefficient α"B has a reference value which is 1.0 assigned to A3 size. The correction coefficient α" is representative of a ratio between the adequate current lout for A3 size at the time of front image transfer and the target current which provides adequate $I_{out}$ for each sheet size and belt (A, B or C) at the time of rear image transfer.

Assume that $I_{out}$ of 50 μA is set, that the belt A is used, that the sheet size is B6, and that the duplex copy mode is selected. Then, as shown in FIG. 23, the transfer control board 29 performs, in the event of front image transfer, $I''_{out}$ =50 μA ×2.3=115 μA, where 2.3 is the correction coefficient α", and sets $I''_{out}$ as a new target current. As shown in FIG. 24, in the event of rear image transfer, the board 29 performs $I''_{out}$=50 μA ×1.6=80 μA and sets $I''_{out}$ as a new target current.

Since the fifth embodiment described above sets a particular target current for each of front image transfer and rear image transfer, it ensures stable image transfer and sheet separation even in the event of rear image transfer.

Likewise, in the combination copy mode, a particular target current may be set for each of the first and second image transfers to a sheet. While the second to fifth embodiments have been shown and described as using correction coefficients in determining a target current, the functions of an equation for calculating a target current on the basis of a sheet size and other factors may be stored in the ROM 32. Then, the transfer control board 29 will determine a target current by use of such an equation. Specifically, assume that the drum 11 and belt 17 directly contact over a width X (ram), and that the belt 17 is 340 mm wide. Then, X is equal to the difference between 340 and sheet size. As a result, a linear function $I_{out}$=f(X) holds. Therefore, if the functions of the equation matching the kinds of the belt 17 are stored in the ROM 32, an optimal function matching $I_1$ or V can be read out of the ROM 32 so as to determine and set adequate $I_{out}$ on the basis of the sheet size.

Now, when the belt A is used and $I_{out}$ of 40 μA is set, the voltage V from the power source 28 to the bias roller 19 is 1.8 kV. On the other hand, when use is made of the belt C and lout of 60 μA is set up, the voltage V is 4.2 kV. Therefore, it is also possible to determine the resistance level of the belt 17 by monitoring the voltage V. A sixth embodiment to be described causes the transfer control board 29 to monitor V in place of $I_1$ and sets lout matching V.

Figure 10:
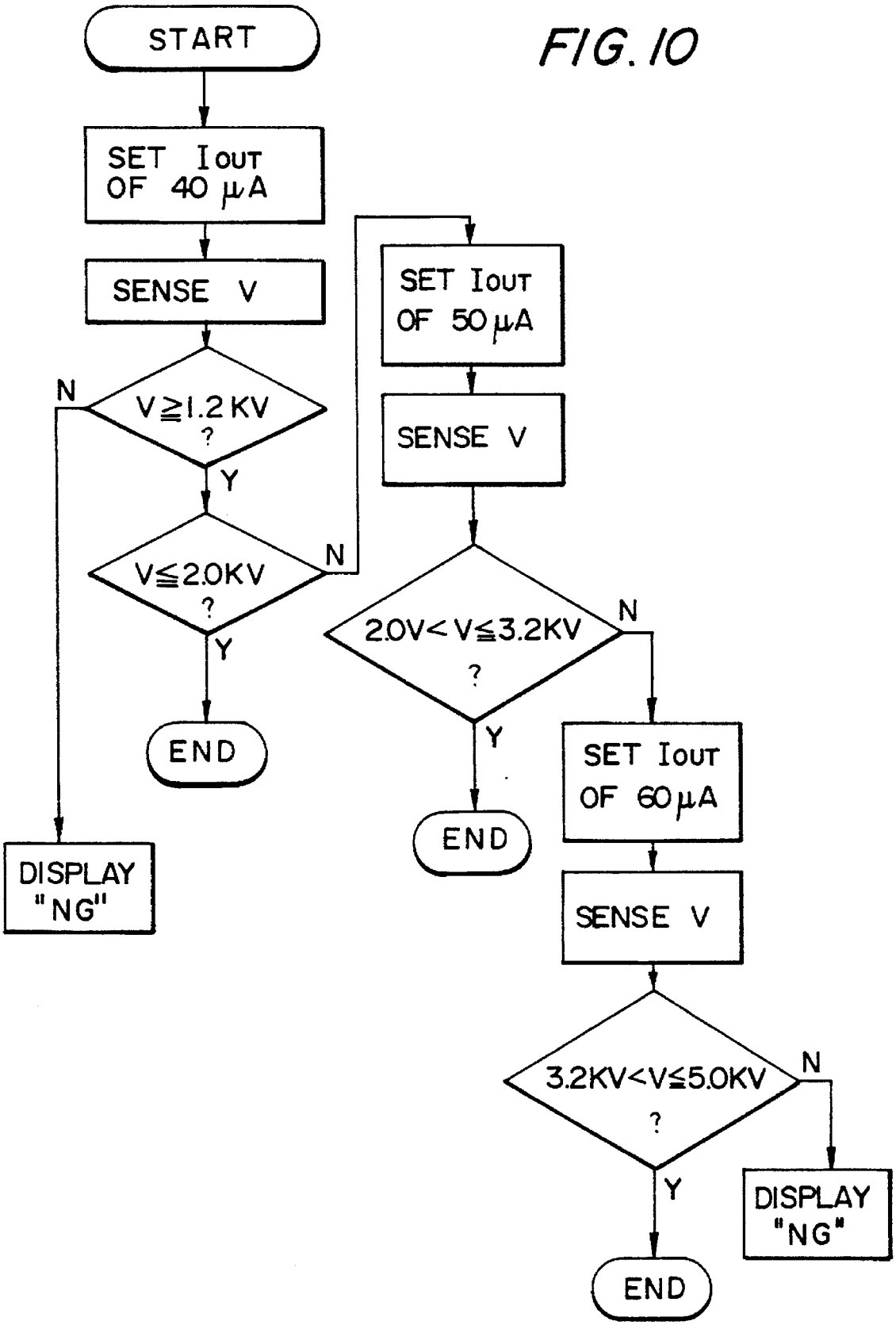
FIG. 10 is a flowchart showing another specific operation of the transfer control board and representative of a sixth embodiment of the present invention.

Specifically, the sixth embodiment executes a specific procedure shown in FIG. 10 in place of the procedure shown in FIG. 7. The belt 17 is pressed against the drum 11 by the lever 24, and the bias is applied from the power source 28 to the bias roller 19. Then, as shown in FIG. 10, the transfer control board controls the current $I_1$ from the power source 28 to the bias roller 19 such that $I_1-I_2=I_{out}$ becomes a predetermined value. In this case, the board 29 sets $I_{out}$ of 40 μA first and detects the resulting voltage V from the power source 28 to the bias roller 19. As shown in FIG. 11, when use is made of the belt A needing $I_{out}$ of 40 μA, the valid range of V (which provides transfer ratios sufficiently higher than a predetermined valne) is from 1.2 kV to 2.0 kV. The board 29 determines whether or not detected V is higher than or equal to 1.2 kV. If the answer of this decision is negative, No, meaning that the belt 17 has an excessively low resistance, the board 29 stops the operation of the apparatus or turns on, for example, a lamp to alert the operator to the unusable belt 17 (NG).

If the detected voltage V is higher or equal to 1.2 kV, the transfer control board 29 sets $I_1-I_2=I_{out}$ at 50 μA, controls the current $I_1$ from the power source 28 to the bias roller 19 such that $I_{out}$ becomes 50 μA, and then detects the resulting voltage V. As shown in FIG. 11, for the belt B needing $I_{out}$ of 50 μA, the valid range of the voltage V is from 2.0 kV to 3.2 kV. Hence, the board 29 determines whether or not the detected voltage V lies in a range of 2.0 kV<V<3.2 kV. If the answer of this decision is negative, No, the board 29 sets $I_{out}$ of 60 μA and controls the current $I_1$ such that $I_{out}$ becomes 60 μA.

As shown in FIG. II, when use is made of the belt C needing $I_{out}$ of 60 μA, the valid range of the voltage V is from 3.2 kV to 5.0 kV. Therefore, the transfer control board 29 detects the voltage V from the power source 28 to the bias roller 19 and then determines whether or not the voltage lies in a range of 3.2 kV<V≦5.0 kV. If the voltage V does not lie in such a range, the board 29 stops the operation of the apparatus or turns on, for example, a lamp to alert the operator to the unusable belt 17 (NG). It is to be noted that if the voltage V is higher than 5.0 kV, the resistance of the belt 17 will be too high to maintain the acceptable image transfer ratio.

As stated above, the sixth embodiment detects, in the first embodiment, the output voltage V of the power source 28 and then sets a target current matching the voltage V. The embodiment, therefore, ensures stable image transfer and sheet separation without regard to the irregular resistance of the belt 17, changes environment, or the kind of sheets. The resistance range of the belt 17 is broadened as a constituent part of the apparatus, increasing yield and reducing cost.

In the sixth embodiment, an arrangement may be made such that the transfer control board 29 detects, in place of the voltage V, a voltage corresponding to a current to flow through the electrode 21 and sets a target value matching the detected current. While the board 29 changes $I_{out}$ in accordance with V while the sheet 12 is not present between the belt 17 and drum 11, it may perform such an operation while the sheet 12 is present therebeween.

The advantages of the various embodiments described above are achievable not only with an image forming apparatus having a negative-to-positive developing device and a color image forming apparatus, but also with any other kind of image forming apparatus so long as the features shown and described are implemented. Changes in the position or configuration and some differences in $I_{out}$,$I_1$, $I_2$ and V do not degrade the advantages at all.

Figure 26:
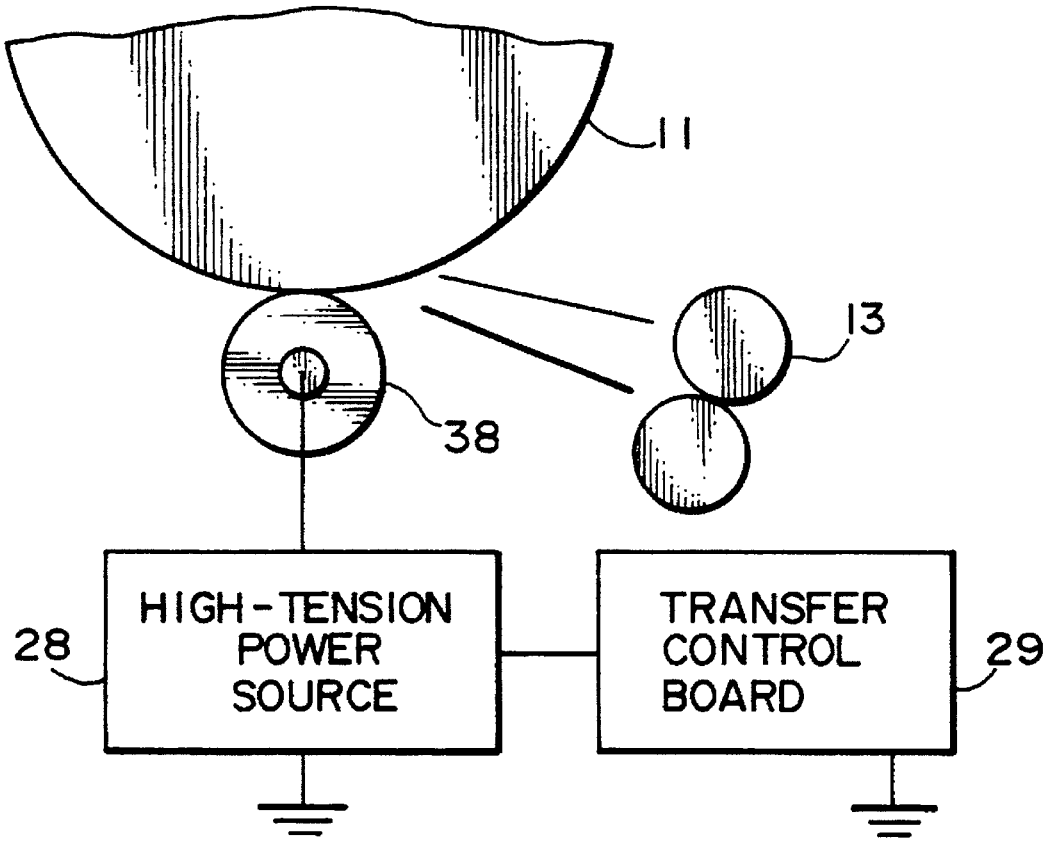
FIG. 26 shows part of another embodiment of the present invention.

As shown in FIG. 26, a transfer roller 38 may be substituted for the belt 17 in any of the embodiments. The roller 38 has an elastic layer whose volume resistivity ranges from $10^7$ Ωcm to $10^{11}$ Ωcm. In the configuration shown in FIG. 26, a bias is also applied from the power source 28 to the roller 38, and the control board maintains the current $I_1$ from the power source 28 constant. While the roller 38 is in rotation in contact with the drum 11, a sheet from the registration roller 13 is brought to the nip portion between the drum 11 and the roller 38. As a result, a toner image is transferred from the drum 11 to the sheet. Subsequently, the sheet is conveyed to the fixing device 16. When such a transfer roller 38 is used, the current $I_2$ is zero.

The present invention, like the embodiments shown and described, is applicable to an image forming apparatus of the type transferring a toner image from an image carrier, or drum, to an intermediate transfer belt, causing the belt to convey the toner image, and then causing a transfer roller to transfer the toner image form the belt to a sheet. This type of apparatus is often implemented as a color image forming apparatus. In this case, the transfer roller is provided with substantially the same configuration as the roller 38, FIG. 26. As a bias is applied from the power source 28 to the roller, the control board 29 maintains the current $I_1$ output from the power source 28 constant, as in the embodiments.

In summary, it will he seen that the present invention provides an image transfer device which ensures stable image transfer and sheet separation without regard to the irregular resistance of a transfer belt, changes in environment, kind of sheets, or image forming mode selected. The resistance range of the belt is broadened as a constituent part of an image forming apparatus, increasing yield and reducing cost.

Various modifications will become possible for those skilled in the art after receiving the teachings of the present disclosure without departing from the scope thereof.

What is claimed is:

1. An image transfer device comprising:

an image carrier for carrying a toner image thereon;

an endless transfer belt for carrying a sheet thereon and transferring the toner image from said image carrier to said sheet;

a first electrode for applying a bias for image transfer to said transfer belt in contact with part of said transfer belt facing said image carrier;

a second electrode contacting said transfer belt;

a power source for applying the bias to said first electrode;

transfer control means for variably controlling, assuming that a current output from said power source is $I_1$, and a current to flow from said power source to said second electrode via said transfer belt ls $I_2$, said current $I_1$, such that $I_1-I_2=I_{out}$ remains at a predetermined target current; and setting means for setting said target current from one of a plurality of target values, said one of a plurality of target values is determined on the basis of a set condition.

2. A device as claimed in claim 1, further comprising current sensing means for sensing a current, said setting means setting said target current on the basis of a current flowing from said power source to said transfer belt.

3. A device as claimed in claim 2, wherein said current sensing means senses one of said current $I_1$ and $I_2$, said setting means setting said target current on the basis of said current $I_1$ or $I_2$.

4. A device as claimed in claim 1, further comprising voltage sensing means for sensing a voltage, said setting means setting said target current on the basis of a voltage applied from said power source 1o said transfer belt.

5. A device as claimed in claim 4, wherein said voltage sensing means senses one of a voltage V output from said power source and a voltage corresponding to a current flowing through said second electrode, said setting means setting said target current on the basis of one of said voltages.

6. A device as claimed in claim 1, wherein setting means selects an adequate target value out of target values each being assigned to a particular set condition.

7. An image transfer device comprising:

an image carrier for carrying a toner image thereon;

movable transferring means contacting a surface of said image carrier for transferring the toner image from said image carrier to a transfer side;

a power source for applying a bias for image transfer to said transferring means;

transfer control means for maintaining a current to be fed from said transferring means to said image carrier during image forming at a predetermined target current;

mode selecting means for selecting and inputting a desired image forming mode; and setting means for setting said target current from one of a plurality of target values, said one of a plurality of target values is determined on the basis of a set condition based on the mode selected.

8. A device as claimed in claim 7, wherein said mode selecting means selects and inputs an image forming mode in which an image is formed a plurality of times on a same sheet.

9. A device as claimed in claim 8, wherein said mode selecting means selects and inputs a duplex mode in which an image is formed on a front and a rear of the same sheet.

10. A device as claimed in claim 8, wherein said mode selecting means selects and inputs a combination mode in which an image is formed a plurality of times on a same side of the same sheet.

11. A device as claimed in claim 7, wherein said mode selecting means selects and inputs a special sheet mode in which an image is formed on a special sheet.

12. A device as claimed in claim 7, wherein said mode selecting means selects and inputs a manual feed mode in which an image is formed on a sheet fed by hand.

13. A device as claimed in claim 7, wherein said setting means selects an adequate target current out of target currents each being assigned to a particular set condition.

14. A device as claimed in claim 7, wherein said image carrier comprises a pholcoonductive clement, said transferring means comprising an endless transfer belt for carrying a sheet thereon and transferring the toner image from said photoconductive element to said sheet.

15. A device as claimed in claim 7, wherein said image carrier comprises a photoconductive element, said transferring means comprising an endless transfer belt for carrying a sheet thereon and transferring the toner image from said photoconductive element to said sheet, said transfer belt having a surface resistivity which is $1\times10^9\ \Omega$ to $1\times10^{12}\ \Omega$ on an outer periphery and $1\times10^7\ \Omega$ to $1\times10^9\ \Omega$ on an inner periphery.

16. A device as claimed in claim 7, wherein said image carrier comprises a photoconductive element, said transferring means comprising a transfer roller for nipping the sheet between said transfer roller and said photoconductive element and transferring the toner image from said photoconductive element to said sheet.

17. A device as claimed in claim 7, wherein said image carrier comprises an intermediate transfer member, said transferring means comprising a transfer roller for nipping the sheet between said transfer roller and said intermediate transfer member and transferring the toner image from said intermediate transfer member to said sheet.

18. An image transfer device comprising:

an image carrier for carrying a toner image thereon;

movable transferring means contacting a surface of said image carrier for transferring the toner image from said image carrier to a transfer side;

a power source for applying a bias for image transfer to said transferring means;

transfer control means for maintaining a current to be fed from said transferring means to said image carrier during image forming at a predetermined target current;

size sensing means for sensing a size of a sheet, on which an image is to be formed, as measured at least in a direction perpendicular to a sheet transport direction; and setting means for setting said target current from one of a plurality of target values, said one of a plurality of target values is determined on the basis of a set condition based on the sheet size sensed.

19. A device as claimed in claim 18, wherein said setting means calculates an adequate target current by using one of correction coefficients each being assigned to a particular set condition.

20. A device as claimed in claim 18, wherein said setting means calculates an adequate target value by using a predetermined equation.

21. A device as claimed in claim 18, wherein said image carrier comprises a photoconductive element, said transferring means comprising an endless transfer belt for carrying a sheet thereon and transferring the toner image from said photoconductive clement to said sheet.

22. A device as claimed in claim 18, wherein said image carrier comprises a photoconductive element, said transferring means comprising an endless transfer belt for carrying a sheet thereon and transferring the toner image from said photoconductive element to said sheet, said transfer belt having a surface resistivity which is $1\times10^9$ Ω to $1\times10^{12}$ Ω on outer periphery and $1\times10^7$ Ω to $1\times10^9$ Ω on an inner periphery.

23. A device as claimed in claim 18, wherein said image carrier comprises a photoconductive element, said transferring means comprising a transfer roller for nipping the sheet between said transfer roller and said photoconductive element and transferring the toner image from said photoconductive element to said sheet.

24. A device as claimed in claim 18, wherein said image carrier comprises an intermediate transfer member, said transferring means comprising a transfer roller for nipping the sheet between said transfer roller and said intermediate transfer member and transferring the toner image from said intermediate transfer member to said sheet.

25. An image transfer device comprising:

an image carrier for carrying a toner image thereon;

movable transferring means contacting a surface of said image carrier for transferring the toner image from said image carrier to a transfer side;

a power source for applying a bias for image transfer to said transferring means;

transfer control means for maintaining a current to be fed from said transferring means to said image carrier during image forming at a predetermined target current;

mode selecting means for selecting and inputting a desired image forming mode; and setting means for setting said target current from one of a plurality of target values, said one of a plurality of target values is determined on the basis of a plurality of set conditions.

26. A device as claimed in claim 25, wherein said setting means sets said target current on matching at least one of a current flowing from said power source to said transferring means and a current $I_1$ output from said power source and an image forming mode selected on said mode selecting means.

27. A device as claimed in claim 25, wherein said setting means sets said target current on the basis of at least one of a current flowing from said power source to said transferring means and a size of a sheet on which an image to be formed.

28. A device as claimed in claim 25, wherein said setting means sets said target current on the basis of an image forming mode selected on said mode selecting means and a size of a sheet on which an image to be formed.

29. A device as claimed in claim 25, wherein said setting means sets said target current on the basis of at least two of a current flowing from said power source to said transferring means, an image forming mode selected on said mode selecting means, and a size of a sheet on which an image is to be formed.

30. A device as claimed in claim 25, wherein said setting means sets said target value on the basis of at least two of a current $I_1$ output from said power source, an image forming mode selected on said mode electing means, and a size of a sheet on which an image is to be formed.

* * * * *